US005613470A

United States Patent [19]

Shiomi et al.

[11] Patent Number: 5,613,470

[45] Date of Patent: Mar. 25, 1997

[54] OUTBOARD ENGINE ASSEMBLY

[75] Inventors: Kazuyuki Shiomi; Hideo Shigedomi; Yasushi Fujita; Yoshiyuki Matsuda; Chiharu Soda; Kazuomi Kiku; Kentaro Furuya, all of Saitama, Japan

[73] Assignee: Honda Giken Kogyo Kabushiki Kaisha, Tokyo, Japan

[21] Appl. No.: 337,560

[22] Filed: Nov. 10, 1994

Related U.S. Application Data

[63] Continuation of Ser. No. 42,552, Apr. 5, 1993, Pat. No. 5,388,555.

[30] Foreign Application Priority Data

Apr. 3, 1992 [JP] Japan ..... 4-110812

[51] Int. Cl.[6] ..... F02F 7/00

[52] U.S. Cl. ..... 123/195 P; 123/196 W; 440/52; 440/900

[58] Field of Search ..... 123/195 HC, 195 P, 123/196 W, 197.4, 55 VF; 440/52, 900

[56] References Cited

U.S. PATENT DOCUMENTS

| | | | |
|---|---|---|---|
| 4,697,557 | 10/1987 | Tamba et al. | 123/195 P |
| 4,846,124 | 7/1989 | Suzuki et al. | 123/195 P |
| 4,903,654 | 2/1990 | Sato et al. | 123/196 W |
| 5,215,164 | 6/1993 | Shibata | 123/196 W |
| 5,388,555 | 2/1995 | Shiomi et al. | 123/195 P |

FOREIGN PATENT DOCUMENTS

| | | |
|---|---|---|
| 60-16722 | 5/1985 | Japan . |

*Primary Examiner*—Noah P. Kamen
*Attorney, Agent, or Firm*—Rosen, Dainow & Jacobs, L.L.P.

[57] ABSTRACT

An outboard engine assembly for use on a boat includes an engine having a substantially vertical crankshaft and a pair of banks of vertically juxtaposed horizontal cylinders, the banks being arranged in a V shape, the cylinders of the banks having axes angularly spaced from each other by an angle of 90° or smaller. The outboard engine assembly has a propeller operatively connected to a downwardly extending vertical shaft coupled to the crankshaft. The engine and the vertical shaft is accommodated in a case assembly. The engine and the case assembly are installed on the hull of the boat by upper and lower support members. Vibroisolating rubber dampers are disposed between the boat hull and the upper and lower support members for isolating vibrations from the engine from the boat hull.

9 Claims, 18 Drawing Sheets

OUTBOARD ENGINE ASSEMBLY

This application is a continuation of application Ser. No. 08/042,552, filed Apr. 5, 1993, now U.S. Pat. No. 3,388,555.

BACKGROUND OF THE INVENTION

1. Field of the Invention

The present invention relates to an outboard engine assembly including an internal combustion engine having a vertical crankshaft.

2. Description of the Prior Art

Internal combustion engines operating on four-stroke cycle for use as outboard engines are advantageous from the standpoints of fuel economy and emission control because they are free of a wasteful discharge of air-fuel mixture which would otherwise occur with two-stroke internal combustion engines.

Outboard engines for use on motorboats should preferably be compact, particularly with respect to height and width, to minimize the engine mass that projects into the motorboat when the engine is tilted up, especially where the engine is mounted on the stern of the motorboat with a partition wall, or to avoid physical interference between two engines mounted on the motorboat when the motorboat is steered. Such a requirement is also to be met by four-stroke outboard engines.

Outboard engines in the form of four-stroke outboard engines of 45 hp have already been put to use. Some outboard engines that are designed for a compact configuration comprise four-stroke outboard engines with vertical crankshafts and three cylinders arranged in line.

Higher engine output power may be achieved by outboard engines with four or more cylinders, which may be arranged in a V shape to meet height and width requirements. A V-shaped four-stroke outboard engine with six cylinders is known from Japanese laid-open patent publication No. 62-267561. The six-cylinder outboard engine is however considerably heavy and large due to an increased number of parts used.

Outboard engines are also required to transmit less vibration to motorboat hulls on which they are mounted. One conventional vibroisolating structure which supports an outboard engine comprises a case having with large recesses defined in a side wall thereof, and rubber mounts fitted in the respective recesses, the outboard engine being supported by the rubber mounts. The case is however relatively low in rigidity, tending to resonate with the engine. The larger the recesses for receiving larger mounts, the lower the rigidity of the case, resulting in greater risk of resonation with the engine.

An outboard engine assembly generally comprises an engine, a vertical shaft coupled to and extending downwardly from the engine, a propeller shaft coupled to the vertical shaft and having a propeller, and a case housing the engine, the vertical shaft, and the propeller shaft. The outboard engine assembly is supported on the stern of a motorboat by an attachment such as a bracket. Thrust forces produced by the propeller are transmitted through the case and the attachment to the hull of the motorboat.

If the engine is larger in size for producing higher engine output power, then the engine is heavier, making it necessary to strengthen the arrangements for supporting the outboard engine assembly and transmitting thrust forces.

Vibration transmitted from the engine to the hull may be attenuated by a resilient vibroisolating body as a rubber mount interposed between the case and the attachment. Since the weight of the outboard engine assembly is imposed on and the thrust forces are applied to the rubber mount, the rubber mount should be harder in the direction in which the thrust forces are applied and softer in all other directions for absorbing applied vibrations. One known such resilient vibroisolating body is disclosed in U.S. Pat. No. 3,599,594. The disclosed resilient vibroisolating body is interposed between a rigid body and an engine case, and is of such a uniform property that its resilient characteristic varies at a uniform rate in the direction in which the thrust forces are applied. Stated otherwise, the resilient vibroisolating body fails to have a harder property desirable when larger thrust forces are applied, a softer property desirable when smaller thrust forces are applied, and a transient property between the harder and softer properties, all in one system.

Certain outboard engine assemblies have a rubber mount comprising a core and a resilient member disposed around the core. The rubber mount together with a cover, which is held against an engine, is fastened downwardly to an engine attachment by a bolt. A space is needed between the engine and the engine attachment for accommodating the rubber mount, and an additional space is also required to house the head of the bolt. If the head of the bolt is to lie flush with the rubber mount, then the region of the cover which receives the head of the bolt has to be reduced in thickness. However, since a clearance is needed between the rubber mount and the cover for the insertion of a fastening tool, the position of the bolt has to be shifted outwardly by a distance corresponding to the clearance. Furthermore, the cover is disposed in a gasket of the engine, and should be designed with sufficient considerations for supporting the outboard engine assembly.

An outboard engine assembly with a vertical shaft is mounted on the stern of a boat hull such that the cylinder axes extend substantially horizontally, the crankcase is positioned closely to the boat hull, and the cylinder head is positioned remotely from the boat hull. To support the outboard engine assembly on the boat hull for isolating engine vibration, it is effective to locate upper mounts for the engine rearwardly of the vertical shaft and support the upper mounts substantially in alignment with a torque roll axis. The upper mounts should preferably be arranged in a closed loop to achieve a sufficient mount frame rigidity against vertical shock loads. One example of such closed-loop configuration is disclosed in U.S. Pat. No. 3,599,594.

Generally, a four-stroke outboard engine assembly has an oil pan positioned below the cylinder block of the engine, so that lubricating oil returns downwardly into the oil pan. U.S. Pat. No. 3,599,594 shows a two-stroke outboard engine, and discloses no lubricating oil system applicable to a four-stroke outboard engine. In a V-shaped four-stroke outboard engine with four cylinders, if the cylinders are ignited at equal intervals, then reactive forces produced by the drive torque of the engine are relatively small, but a primary inertial couple is relatively large. If the cylinders are ignited at unequal intervals and the crankpins are angularly spaced 180° from each other, then a primary inertial couple is reduced, but reactive forces produced by the drive torque of the engine are relatively large. Therefore, large vibrations are transmitted from the outboard engine to the boat hull on which it is mounted.

SUMMARY OF THE INVENTION

It is an object of the present invention to provide an outboard engine assembly which comprises a compact and lightweight four-stroke engine, and which transmits less vibration to a boat hull on which the outboard engine is mounted.

Another object of the present invention is to provide an outboard engine assembly having an engine case with a high vibroisolating capability.

Still another object of the present invention is to provide an outboard engine assembly which is capable of producing high engine output power and has vibroisolating means comprising resilient members that are harder when larger thrust forces are applied and softer otherwise, in the direction in which the thrust forces are applied.

Yet another object of the present invention is to provide an outboard engine assembly having an upper engine mount that is installed in a compact configuration without affecting the outer dimensions of the outboard engine assembly.

A further object of the present invention is to provide an outboard engine assembly including an upper mount attachment structure and an oil return structure that may apply to a four-stroke engine.

A still further object of the present invention is to provide a V-shaped four-cylinder four-stroke engine which can reduce a primary inertial couple while reducing reactive forces of the drive torque even when the four cylinders are ignited at unequal intervals.

According to the present invention, there is provided an outboard engine assembly comprising an engine having a substantially vertical crankshaft and a pair of banks of vertically juxtaposed horizontal cylinders, the banks being arranged in a V shape, the cylinders of the banks having axes angularly spaced from each other by an angle of 90° or smaller, a vertical shaft coupled to the crankshaft and extending downwardly, a propeller operatively connected to the vertical shaft, case means for housing the engine and the vertical shaft therein, attachment means for supporting the engine and the case means on a boat hull, and vibroisolating means disposed between the attachment means and the boat hull for isolating vibrations from the engine from the boat hull.

According to the present invention, there is also provided an outboard engine assembly comprising an engine having a substantially vertical crankshaft and a plurality of horizontal cylinders, a vertical shaft coupled to the crankshaft and extending downwardly, a propeller operatively connected to the vertical shaft, case means for housing the engine and the vertical shaft therein, attachment means for supporting the engine and the case means on a boat hull, the attachment means comprising upper and lower support members, and vibroisolating means disposed between the attachment means and the boat hull for isolating vibrations from the engine from the boat hull, the vibroisolating means comprises upper and lower vibroisolating means, the lower vibroisolating means and the lower support member being joined to each other by connecting members, the case means having a first space accommodating the vertical shaft, a second space defined rearwardly of the first space and accommodating the lower vibroisolating means which is laterally inserted, third spaces positioned laterally of the first space and accommodating the connecting members, and stiffeners disposed one on each side of the third spaces.

According to the present invention, there is further provided an outboard engine assembly comprising an engine having a substantially vertical crankshaft and a plurality of horizontal cylinders, a vertical shaft coupled to the crankshaft and extending downwardly, a propeller operatively connected to the vertical shaft, case means for housing the engine and the vertical shaft therein, attachment means for supporting the engine and the case means on a boat hull, the attachment means comprising upper and lower support members, and vibroisolating means disposed between the attachment means and the boat hull for isolating vibrations from the engine from the boat hull, the case means having a space including a plane substantially perpendicularly to the direction in which thrust forces are produced by the propeller, the vibroisolating means comprising a rigid member housed in the space and extending substantially perpendicularly to the direction, and a resilient member disposed around the rigid member, the attachment means comprising a support member having a pair of laterally spaced arms coupled to opposite ends, respectively, of the rigid member, the resilient member being shaped such that the surface area of a surface thereof which contacts a surface in the space across the direction increases as the thrust forces increase.

According to the present invention, there is further provided an outboard engine assembly comprising an engine having a substantially vertical crankshaft and a plurality of horizontal cylinders, a vertical shaft coupled to the crankshaft and extending downwardly, a propeller operatively connected to the vertical shaft, case means for housing the engine and the vertical shaft therein, attachment means for supporting the engine and the case means on a boat hull, the attachment means comprising upper and lower support members, vibroisolating means disposed between the attachment means and the boat hull for isolating vibrations from the engine from the boat hull, the vibroisolating means comprising a rigid member extending laterally and a resilient member disposed around the rigid member, and a mount case mounted on a lower portion of the engine and having a downwardly opening cavity defined therein, the rigid member and the resilient member being inserted upwardly into and housed in the cavity.

According to the present invention, there is also provided an outboard engine assembly comprising an engine having a substantially vertical crankshaft and a plurality of horizontal cylinders arranged in a pair of banks angularly spaced in a V shape, the engine including a cylinder block including a crank chamber, a cylinder head mounted on the cylinder block and having laterally spaced portions, and an oil pan disposed below the cylinder block, first oil return passages extending from the laterally spaced portions of the cylinder head, and a second oil return passage extending from the crank chamber, the first oil return passages being independent of each other, the second oil return passage being disposed between and independent of the first oil return passages.

According to the present invention, there is also provided a V-shaped four-cylinder four-stroke engine comprising a pair of banks each composed of two cylinders, the cylinders of the banks having axes angularly spaced in a V shape at an angle of $\theta$ and being ignitable at unequal intervals, first, second, third, and fourth pistons slidably fitted in the cylinders, respectively, and a crankshaft having first, second, third, and fourth crankpins successively from an end thereof which are connected respectively to the first, second, third, and fourth pistons, the first and second crankpins being angularly spaced from each other by an angle of $\pi-2\theta$, the first and third crankpins being angularly positioned 360° out of phase with each other, and the second and fourth crankpins being angularly positioned 360° out of phase with each other, the arrangement being such that reciprocating masses in the second and third cylinders are larger than reciprocating masses in the first and fourth cylinders.

The above and further objects, details and advantages of the present invention will become apparent from the following detailed description of preferred embodiments thereof, when read in conjunction with the accompanying drawings.

DETAILED DESCRIPTION OF THE PREFERRED EMBODIMENTS

Figure 1:
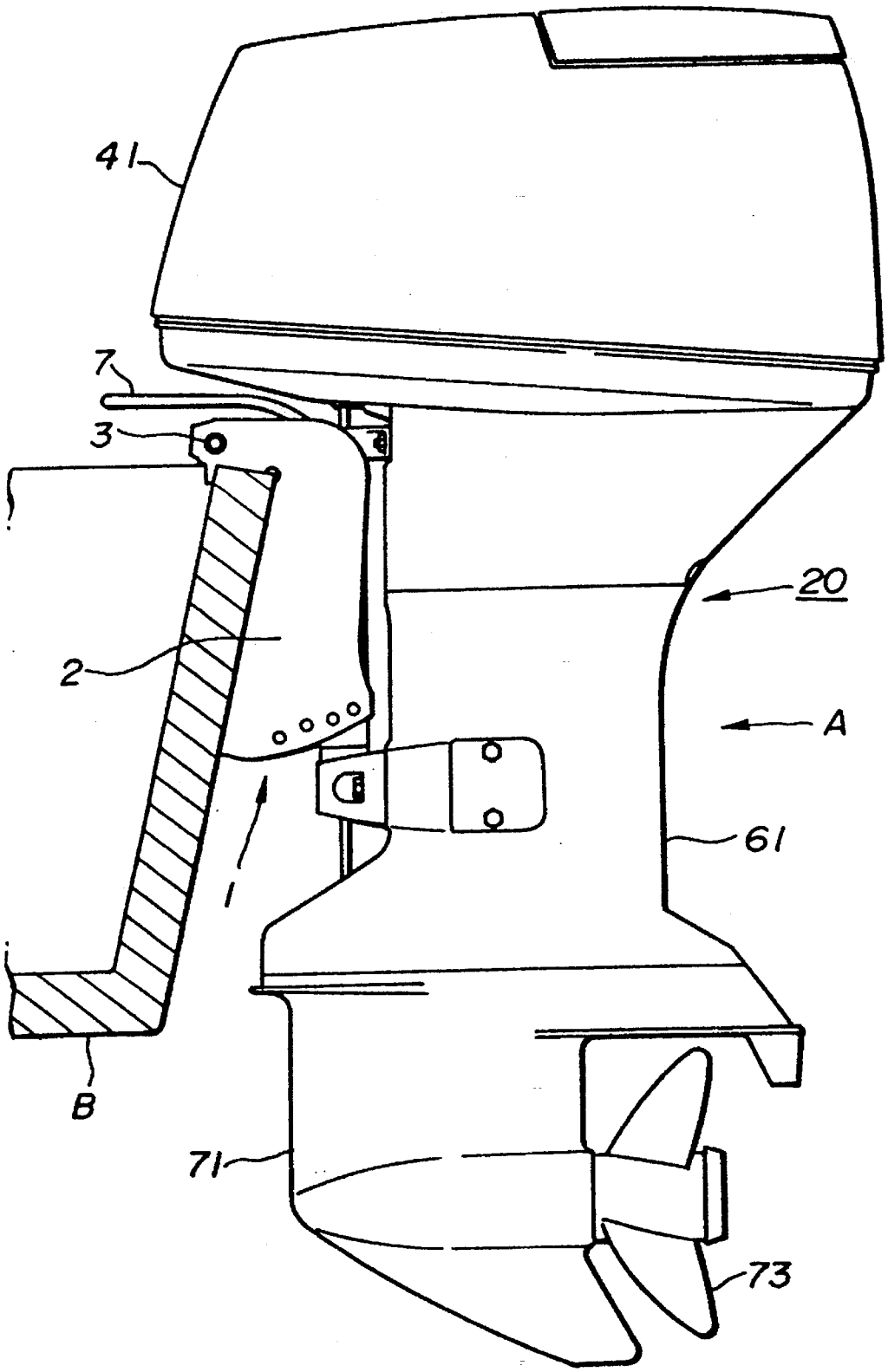
FIG. 1 is a side elevational view of an outboard engine assembly according to an embodiment of the present invention.

As shown in FIG. 1, an outboard engine assembly, generally designated by the reference numeral 20, according to an embodiment of the present invention is mounted on the stern of the hull B of a motorboat by an attachment assembly 1.

Figure 2:
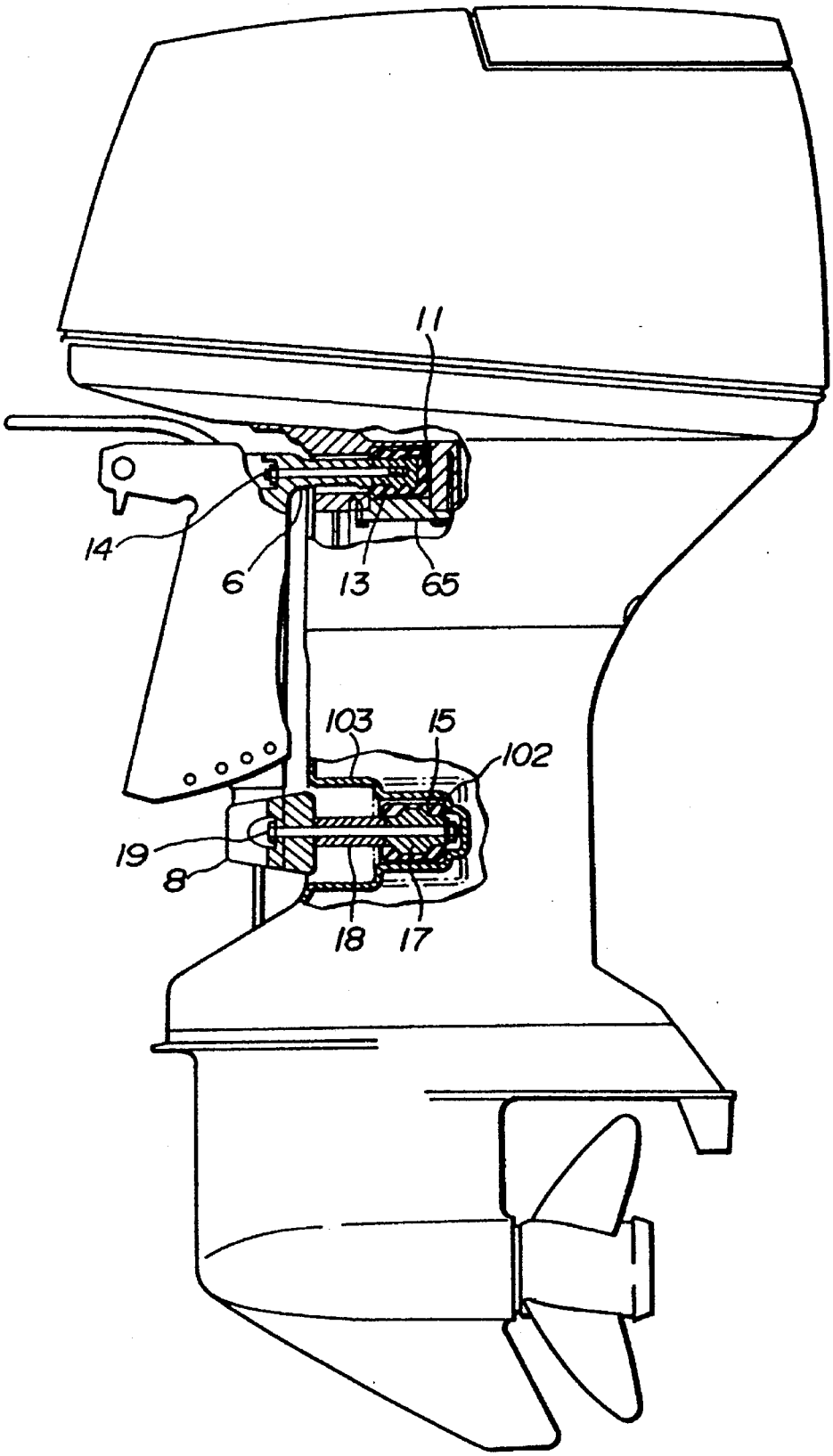
FIG. 2 is a side elevational view, partly in cross section, of the outboard engine assembly shown in FIG. 1, the view showing vibroisolating means.
Figure 3:
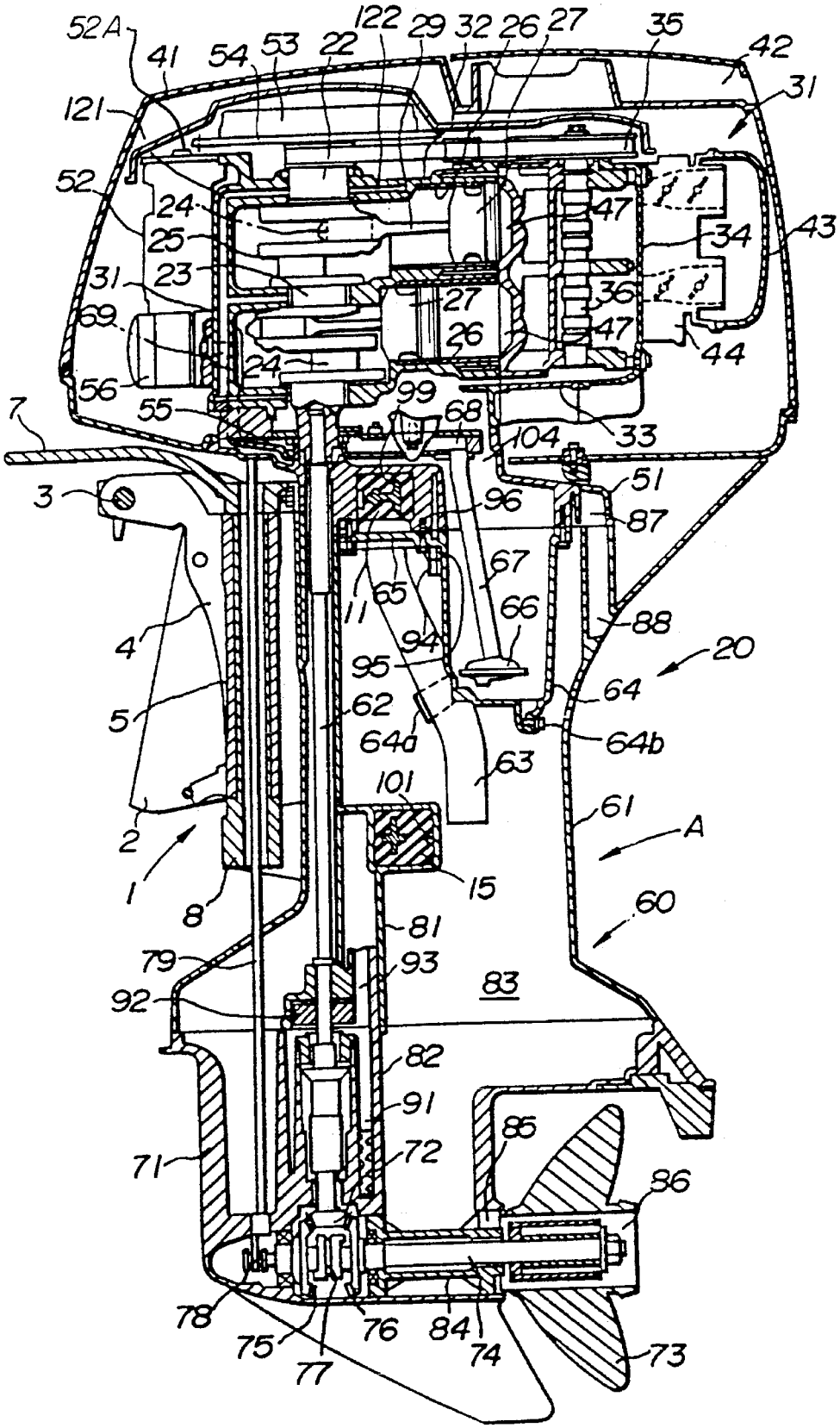
FIG. 3 is a vertical cross-sectional view of the outboard engine assembly shown in FIG. 1.
Figure 4:
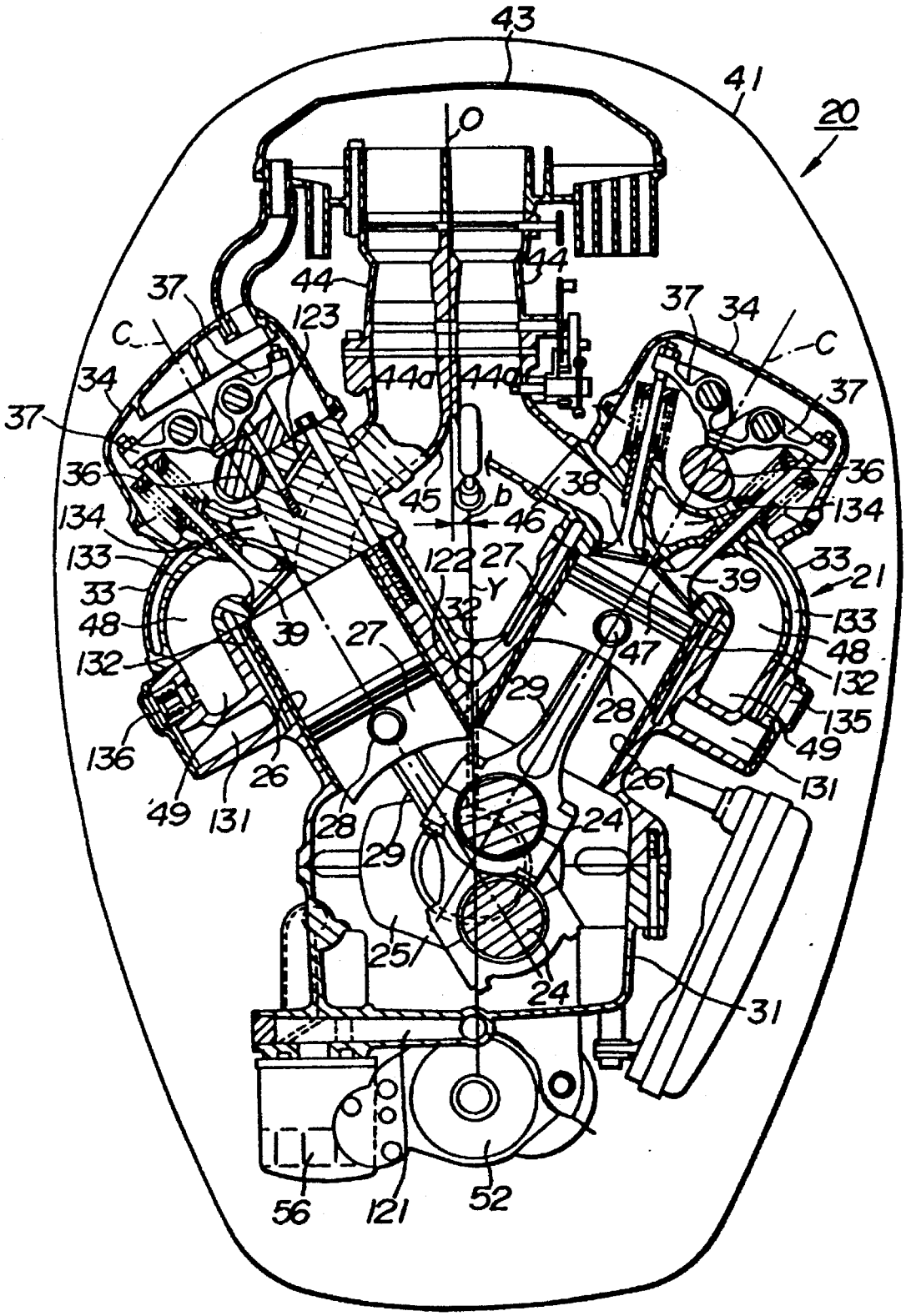
FIG. 4 is a horizontal cross-sectional view of an engine of the outboard engine assembly shown in FIG. 3.

As shown in FIGS. 3 and 4, the attachment assembly 1 comprises a stern bracket 2 secured to the stern of the motorboat hull B, a swivel case 4 swingably supported on the stern bracket 2 by a tilt shaft 3 having a horizontal axis, a swivel shaft 5 angularly movably supported on the swivel case 4 and having a substantially vertical axis, and upper and lower support members 6, 8 (see also FIG. 2) integrally formed with upper and lower portions, respectively, of the swivel shaft 5 and supporting the outboard engine assembly 20. A steering handle or remote control steering cable attachment 7 which extends forwardly is integrally joined to the upper support member 6.

As shown in FIG. 2, the outboard engine assembly 20 is supported on the upper and lower support members 6, 8 by respective vibroisolating means 11, 15 comprising rubber dampers.

As shown in FIGS. 3 and 4, the outboard engine assembly 20 comprises a V-shaped four-cylinder four-stroke internal combustion engine 21 having a substantially vertical crankshaft 22 and two banks of upper and lower cylinders 26 defined in a cylinder block 32 and axially opening rearwardly, the banks being spread forwardly in a V shape and having respective cylinder axes C that are angularly spaced from each other by an angle of 90° or smaller. The outboard engine assembly 20 also has a case assembly 60 disposed downwardly of the engine 21.

The crankshaft 22 has a plurality of journals 23 rotatably supported in a crankcase 31, four crankpins 24, and a plurality of crank webs 25 coupled to the journals 23 and supporting the crankpins 24. The engine 21 includes four pistons 27 slidably fitted in the respective cylinders 26, four connecting rods 29 coupled to the respective crankpins 24 and also to the respective pistons 27 by respective piston pins 28, a cylinder head 33 mounted on the cylinder block 32, and a cylinder head cover 34 covering the cylinder head 33. A timing belt device 35 comprises a timing belt trained around a pulley mounted on an end of the crankshaft 22 and another pulley mounted on an end of a camshaft 36 that is rotatably disposed in the cylinder head 33 and the cylinder head cover 34. Rocker arms 37 are swingably mounted in the cylinder head cover 34 and operatively coupled to intake and exhaust valves 38, 39 that are axially slidably supported in the cylinder head 33.

The V-shaped space defined between the banks of cylinders 26 accommodates therein an intake manifold 45 having intake passages 46 connected to intake ports that are defined in the cylinder head 33 and in which the intake valves 38 extend. When the intake valves 38 are open, the intake ports communicate with combustion chambers 47 defined in the cylinder head 33 in communication with the respective cylinders 26. The intake manifold 45 is bolted to the cylinder head 33 so as to extend across the V-shaped space. The V-shaped space also houses therein a pair of carburetors 44 having respective horizontal intake passageways 44*a* connected to the intake passages 46, and a silencer 43 coupled to the carburetors 44 and communicating with an air inlet 42 that is defined in an engine cover 41 which covers the engine 21.

As shown in FIG. 4, the carburetors 44 are spaced equally from the downstream ends of the intake passages 46, i.e., the intake ports in the cylinder head 33. The banks of cylinders 26 are positioned one on each side of a central plane Y of the engine 21. A plane O between the carburetors 44 is displaced or offset from the central plane Y toward the lefthand cylinder bank by a distance b. Therefore, the intake passage or pipe systems joined to the banks of cylinders 26 are substantially equalized in length for equally increasing the charging efficiency of the banks of cylinders 26 based on the inertial induction effect for increased engine output power.

Air is introduced from the air inlet 42 through the silencer 43 into the carburetors 44, which produces an air-fuel mixture that is supplied through the intake passages 46 and the intake ports into the combustion chambers 47 when the intake valves 38 are opened. Exhaust gases produced upon combustion of the air-fuel mixture in the combustion chambers 47 are discharged from the exhaust valves 39 when they are opened through exhaust passages 48 defined in the cylinder head 33 at its outer regions remote from the V-shaped space between the banks of cylinders 26 and also through vertical exhaust passages 49 defined in the cylinder block 32 at its outer regions remote from the V-shaped space between the banks of cylinders 26.

As shown in FIG. 3, a mount case 51 which is disposed underneath the engine 21 is bolted to a lower surface of the crankcase 31 and a lower surface of the cylinder block 32.

The outboard engine assembly 20 includes a starter motor 52 for starting the engine 21, a flywheel 53 coupled to the crankshaft 22, a ring gear 54 mounted on the periphery of the flywheel 53 and coupled during starting operation to the starter motor 52 through a pinion 52A mounted on the starter motor an oil pump 55 connected to a lower end of the crankshaft 22, and an oil filter 56 mounted on the frontside of crankcase 31 and communicating with the oil pump 55.

The case assembly 60 comprises an extension case 61 bolted to a lower surface of the mount case 51 and a gear case 71 bolted to a lower surface of the extension case 61.

The extension case 61 houses a vertical shaft 62 directly connected to the lower end of the crankshaft 22, two exhaust pipes 63 connected to and extending downwardly from the respective exhaust passages 49, and an oil pan 64 bolted to the lower surface of the mount case 51. The exhaust pipes 63 are supported on the oil pan 64 by a support stay 64*a*. The oil pan 64 has an oil drain bolt 64*b* threaded into its bottom.

The oil pan 64 has an integral upper mount cover 65 extending laterally therefrom. An oil strainer 66 attached to a lower end of an oil supply pipe 67 is positioned in the oil pan 64, the oil supply pipe 67 being connected to a horizontal oil inlet passage 68 defined in the cylinder block 32 and extending through the oil pump 55. The oil inlet passage 63 is connected to a vertical oil discharge passage 69 defined in the crankcase 31.

The gear case 71 houses a lower portion of the vertical shaft 62, a drive bevel gear 72 mounted on a lower end of the vertical shaft 62, a propeller shaft 74 having a propeller 73 mounted on one end thereof, a pair of driven bevel gears 75, 76 mounted on the other end of the propeller shaft 74 for transmitting rotational forces from the drive bevel gear 72 selectively through the driven bevel gears 75, 76 to rotate the propeller shaft 74 in one direction or the other to propel the motorboat forwardly or rearwardly, a dog clutch 77 disposed between the driven bevel gears 74 for selecting the driven bevel gear 75 or 76 to rotate the propeller shaft 74, an eccentric clutch control mechanism 78 for controlling the dog clutch 77, and a control shaft 79 coupled to the eccentric clutch control mechanism 78. The control shaft 79 extends upwardly from the gear case 71 through a lower portion of the extension case 61 and also through the swivel shaft 5 into the engine cover 41 where the control shaft 79 is connected to a control device (not shown).

Partitions 81, 82 are disposed in the extension case 61 and the gear case 71, respectively, behind the vertical shaft 62. The extension case 61 and the gear case 71 have an exhaust chamber 83 defined therein rearwardly of the partitions 81, 82.

When a lower portion of the outboard engine assembly 20 is immersed in water and the motorboat is being propelled by the propeller 73, exhaust gases discharged from the exhaust pipes 63 into the exhaust chamber 83 flow from a lower portion of the exhaust chamber 83 through an exhaust hole 85 defined between the gear case 71 and a propeller shaft holder 84 through which the propeller shaft 74 extends, and are discharged from an exhaust port 86 defined centrally in the propeller 73 into the water. When the lower portion of the outboard engine assembly 20 is immersed in water and the engine 21 is idling, exhaust gases discharged from the exhaust pipes 63 into the exhaust chamber 83 flow from an upper portion of the exhaust chamber 83 through an exhaust passage 87 defined in a lower portion of the mount case 51, and are discharged from an exhaust port 88 defined in an upper portion of the extension case 61 into the atmosphere.

A coolant chamber 91 is defined around a lower portion of the vertical shaft 62 forwardly of the partition 82 in the gear case 71. A coolant pump 92 is disposed around the vertical shaft 62 above the coolant chamber 91 and has a coolant outlet 93 connected through a hose 94 to a coolant inlet 95 on the upper mount cover 65.

Figure 5:
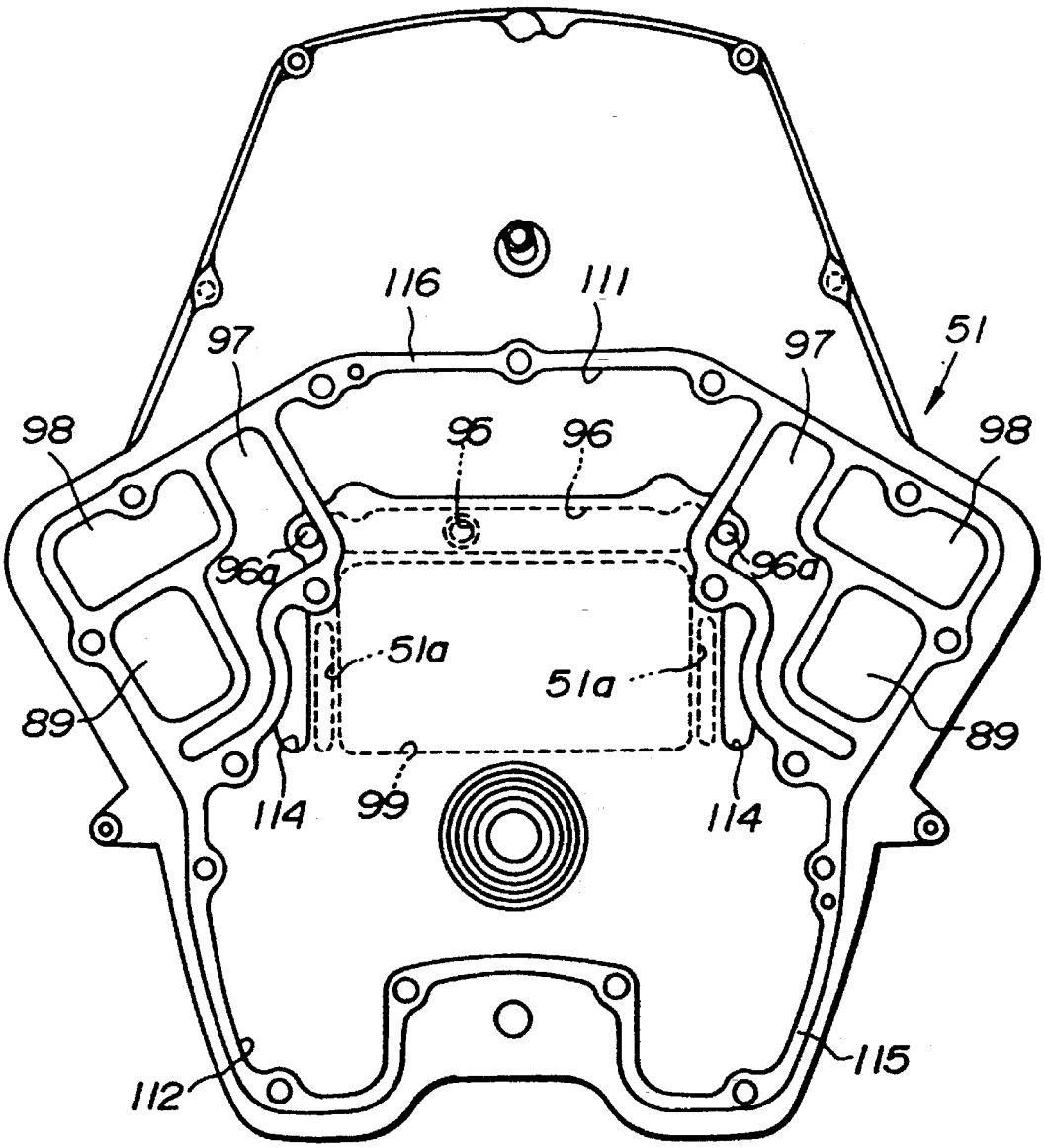
FIG. 5 is a plan view of a mount case of the outboard engine assembly shown in FIG. 3.
Figure 6:
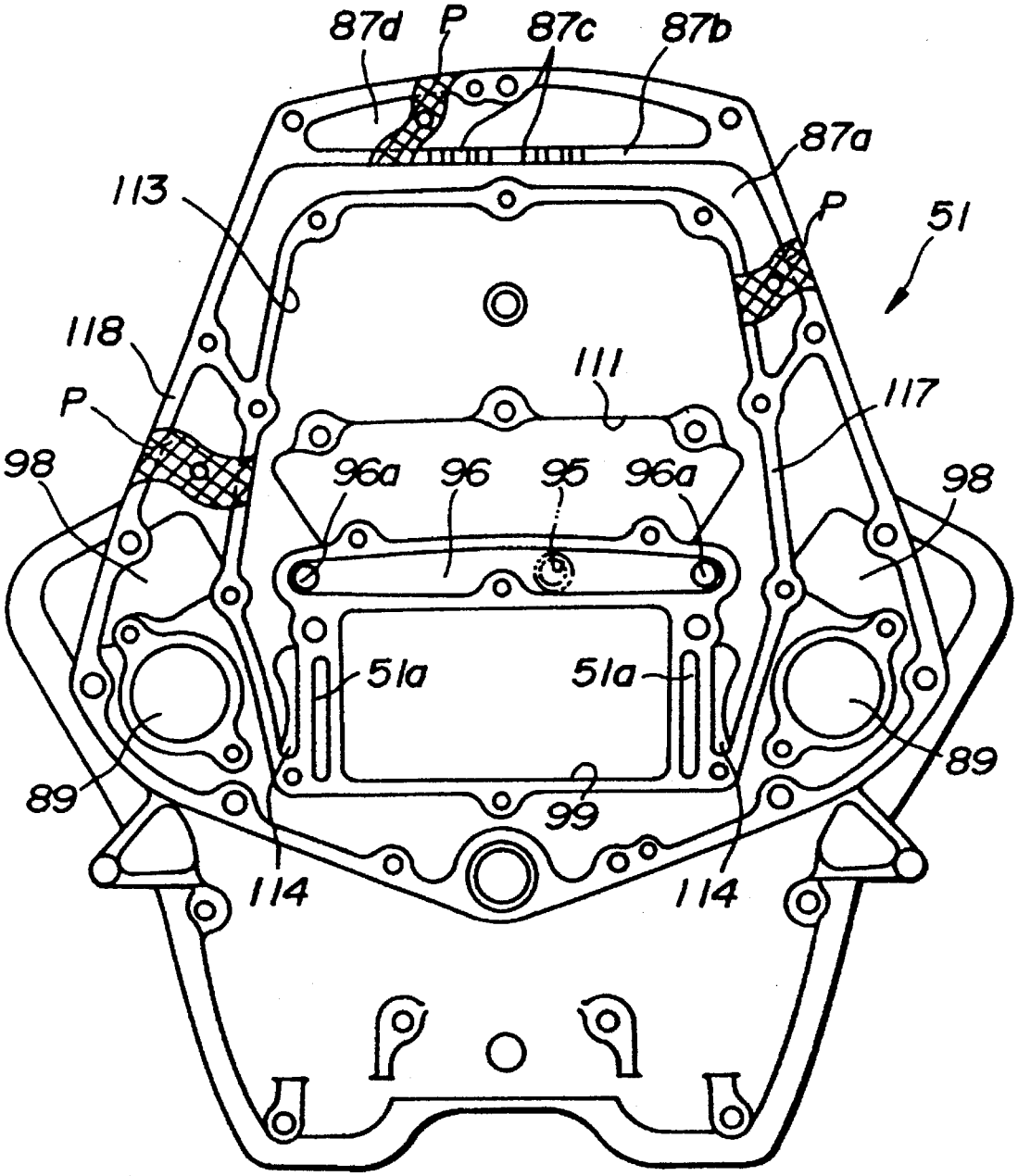
FIG. 6 is a bottom view of the mount case shown in FIG. 5.

As shown in FIGS. 5 and 6, the coolant inlet 95 communicates with a coolant passage 96 defined in the lower surface of the mount case 51. The coolant passage 96 has a pair of laterally spaced holes 96*a* communicating respectively with coolant passages 97 defined in the mount case 51 above the holes 96*a*. The mount case 51 also has a pair of coolant drain ports 98 defined vertically therethrough outwardly of the respective coolant passages 97, and a pair of exhaust passages 89 defined therein adjacent to the coolant drain ports 98. The exhaust passages 89 have upper ends connected to the respective exhaust passages 49 defined in the cylinder block 32 and lower ends connected to the respective exhaust pipes 63.

The mount case 51 has an upper mount storage cavity 99 defined centrally therein which opens downwardly and stores the vibroisolating means 11 for the upper support member 6. The upper mount storage cavity 99 is of a substantially rectangular shape defined by a laterally extending flat surface substantially parallel to the vibroisolating means 11 and flat surfaces substantially perpendicular to the flat surface.

Figure 7:
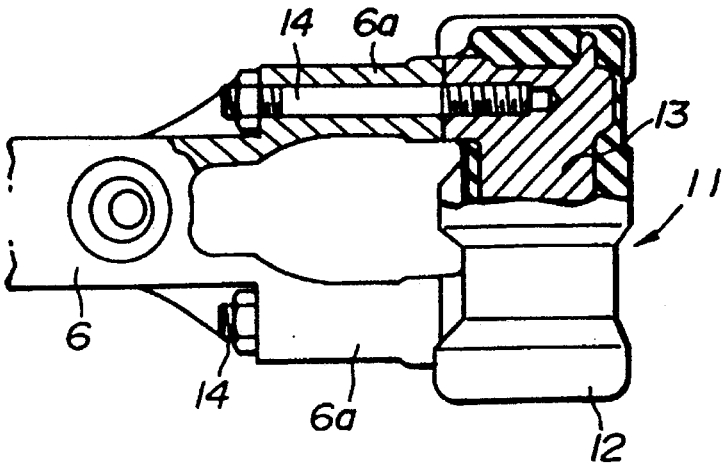
FIG. 7 is a plan view, partly in cross section, of an upper rubber mount or vibroisolating means of the outboard engine assembly shown in FIG. 3.

As shown in FIG. 7, the vibroisolating means 11 comprises a resilient upper rubber mount 12 with a laterally extending rigid core 13 embedded therein. The resilient upper rubber mount 12 is symmetrical in shape with respect to its transverse central axis.

Figure 9:
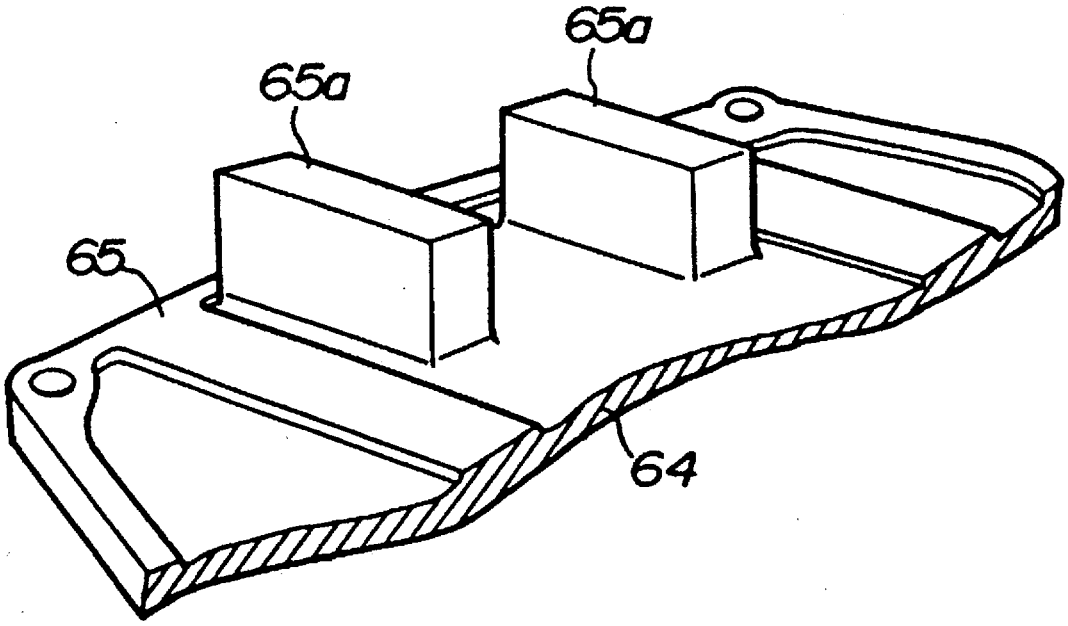
FIG. 9 is a fragmentary perspective view of an upper mount cover with a pair of legs.
Figure 10A:
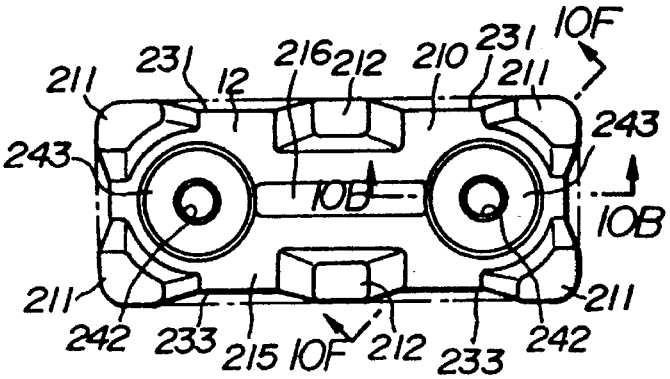
FIG. 10A is a front elevational view of the upper rubber mount.
Figure 10D:
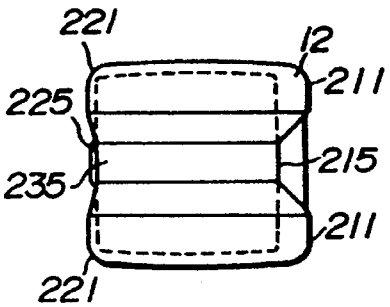
FIG. 10D is a side elevational view of the upper rubber mount.
Figure 10B:
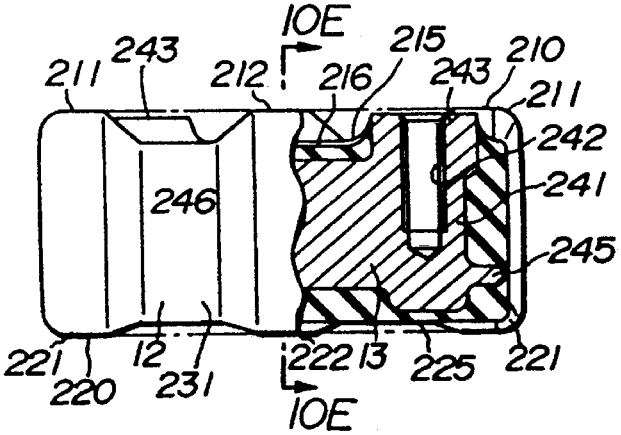
FIG. 10B is a plan view of the upper rubber mount, partly in a cross section taken along line 10B—10B of FIG. 10A.
Figure 10E:
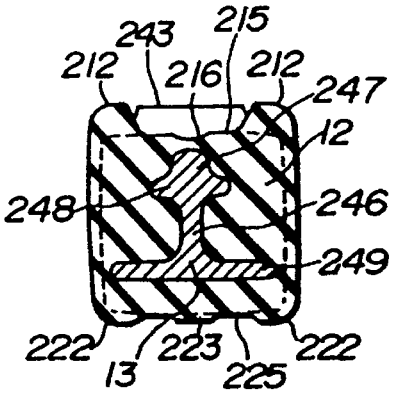
FIG. 10E is a cross-sectional view taken along line 10E—10E of FIG. 10B.
Figure 10C:
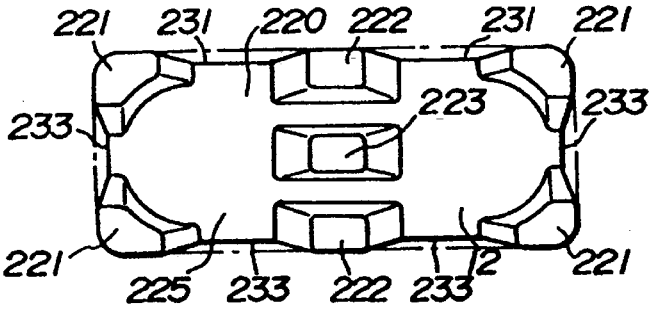
FIG. 10C is a rear elevational view of the upper rubber mount.
Figure 10F:
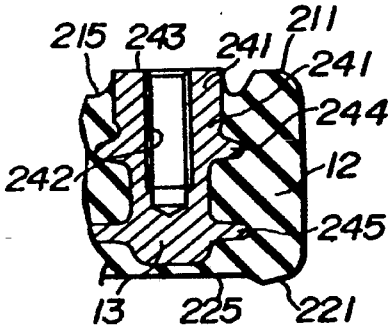
FIG. 10F is a cross-sectional view taken along line 10F—10F of FIG. 10A.
Figure 11A:
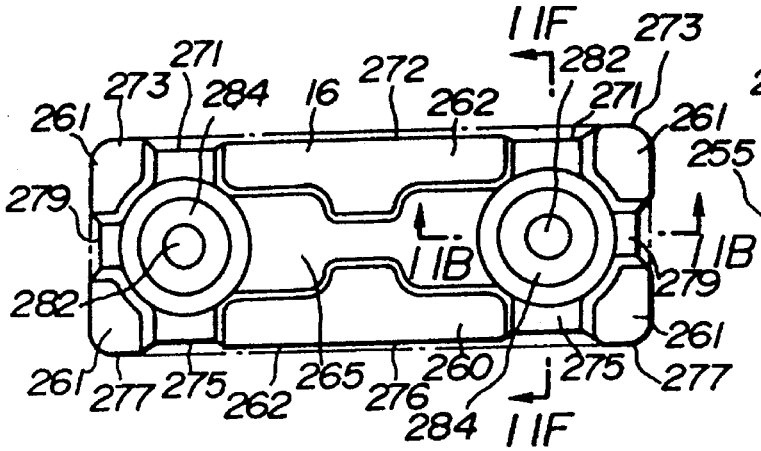
FIG. 11A is a rear elevational view of the lower rubber mount.
Figure 11D:
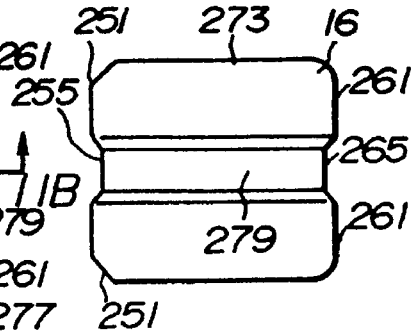
FIG. 11D is a side elevational view of the lower rubber mount.
Figure 11B:
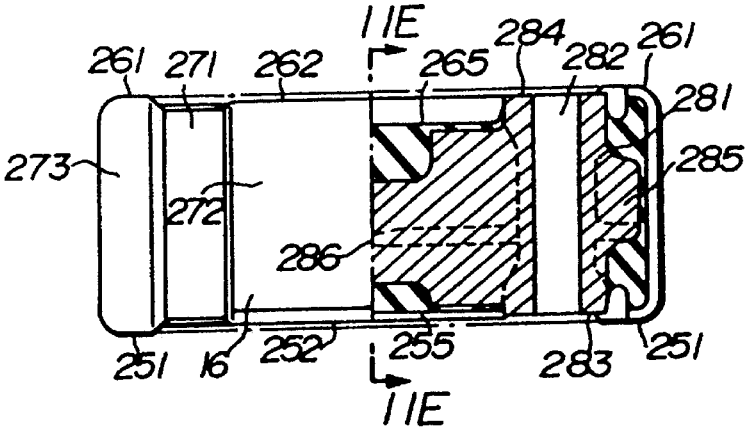
FIG. 11B is a plan view of the lower rubber mount, partly in a cross section taken along line 11B—11B of FIG. 11A.
Figure 11E:
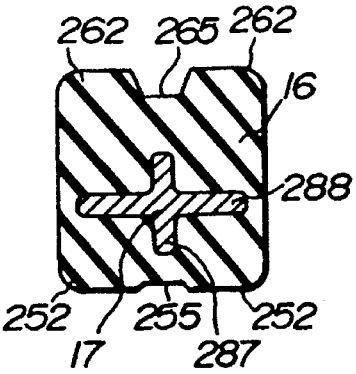
FIG. 11E is a cross-sectional view taken along line 11E—11E of FIG. 11B.
Figure 11C:
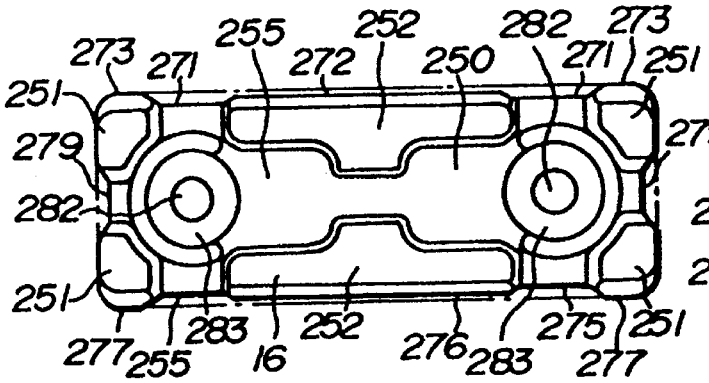
FIG. 11C is a front elevational view of the lower rubber mount.
Figure 11F:
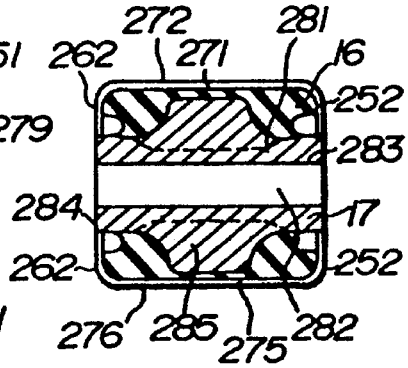
FIG. 11F is a cross-sectional view taken along line 11F—11F of FIG. 11A.

To assemble the resilient upper rubber mount 12 in place, it is inserted upwardly into the upper mount storage cavity 99, and the core 13 is fastened to two laterally spaced arms 6*a* of the upper support member 6 by bolts and nuts 14. Thereafter, the upper mount storage cavity 99 is closed by the upper mount cover 65 that is fastened to the central lower surface of the mount case 51 by bolts. The upper mount cover 65 has a pair of spaced legs 65*a* (see FIG. 9) extending into abutment against the resilient upper rubber mount 12 of the vibroisolating means 11.

The upper rubber mount 12 has front and rear surfaces 210, 220 held in contact with respective front and rear surfaces of the upper mount storage cavity 99 which lie perpendicularly to the direction in which thrust forces are applied by the propeller 73. The front and rear surfaces 210, 220 have surface irregularities, i.e., lands and recesses, such that the surface areas of the front and rear surfaces 210, 220 which contact the front and rear surfaces of the upper mount storage cavity 99 increase as the applied thrust forces are increased. The upper rubber mount 12 has nonlinear resilient characteristics.

More specifically, as shown in FIGS. 10A through 10F, the front surface 210 comprises four corner lands 211 which are held against the corresponding front surface of the upper mount storage cavity 99 when the thrust forces are relatively small upon forward movement of the motorboat, upper and lower lands 212 positioned between the corner lands 211, a flat area 215 which is held against the corresponding front surface of the upper mount storage cavity 99 when the forward thrust forces are increased, and a small horizontal recess 216 defined centrally in the flat area 215.

The rear surface 220 comprises four corner lands 221 which are held against the corresponding rear surface of the upper mount storage cavity 99 when the thrust forces are relatively small upon rearward movement of the motorboat, upper and lower lands 222 positioned between the corner lands 221, a central land 223 positioned between the upper and lower lands 222, and a flat area 225 which is held against the corresponding front surface of the upper mount storage cavity 99 when the rearward or reverse thrust forces are increased.

The upper rubber mount 12 also has a pair of laterally spaced recesses 231 defined in its upper surface and extending transversely thereacross, i.e., in the fore-and-aft direction of the motorboat, a pair of laterally spaced recesses 233 defined in its lower surface and extending transversely thereacross in the fore-and-aft direction of the motorboat, and a pair of recesses 235 defined respectively in its opposite sides and extending transversely thereacross in the fore-and-aft direction of the motorboat.

The core 13 has a pair of laterally spaced bosses 241 and a joint 246 integrally joined to and extending between the bosses 241. The bosses 241 have respective forwardly opening internally threaded holes 242 in which the bolts 14 are threaded, and respective front surfaces 243 joined to the respective arms 6*a*.

Each of the bosses 241 has a surrounding front flange 244 and a surrounding rear flange 245 spaced rearwardly from the front flange 244. The joint 246 has a horizontal panel 247 extending between the bosses 241, a front vertical ridge 248 on a front portion of the horizontal panel 247, and a vertical panel 249 on a rear end of the horizontal panel 247.

The extension case 61 has a lower mount storage cavity 101 defined in a lower portion thereof which cavity opens laterally and stores the vibroisolating means 15 for the lower support member 8.

Figure 8:
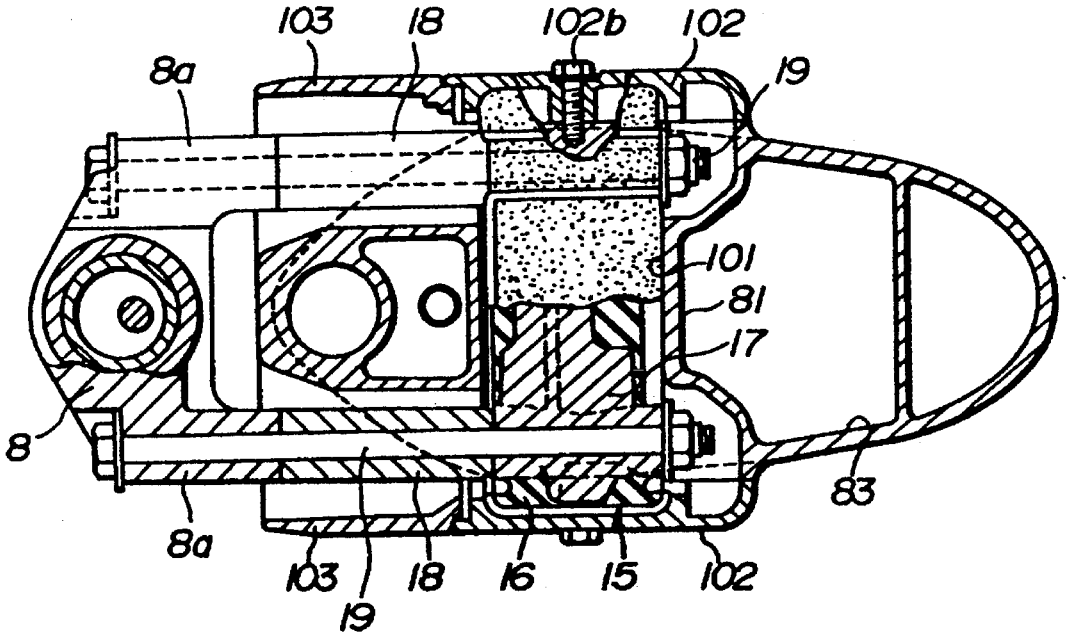
FIG. 8 is a horizontal cross-sectional view of a lower rubber mount or vibroisolating means of the outboard engine assembly shown in FIG. 3.

As shown in FIG. 8, the vibroisolating means 15 comprises a resilient lower rubber mount 16 with a laterally extending rigid core 17 embedded therein.

To assemble the resilient lower rubber mount 16 in place, it is inserted laterally from one side into the lower mount storage cavity 101, and the core 17 is fastened to two laterally spaced arms 8*a* of the lower support member 8 by bolts and nuts 19, the bolts extending through collars 18. Thereafter, the lower mount storage cavity 101 is closed by covers 102 that are fastened to laterally opposite surfaces of the extension case 61 by bolts. The extension case 61 has integral stiffeners 103 extending forwardly from the respective open ends of the lower mount storage cavity 101 substantially flush with the covers 102.

The lower rubber mount 15 has front and rear surfaces 250, 260 held in contact with respective front and rear surfaces of the lower mount storage cavity 101 which lie perpendicularly to the direction in which thrust forces are applied by the propeller 73. The front and rear surfaces 250, 260 have surface irregularities, i.e., lands and recesses, such that the surface areas of the front and rear surfaces 250, 260 which contact the front and rear surfaces of the lower mount storage cavity 101 increase as the applied thrust forces are increased.

More specifically, as shown in FIGS. 11A through 11F, the front surface 250 comprises four corner lands 251 which are held against the corresponding front surface of the lower mount storage cavity 101 when the thrust forces are relatively small upon rearward or reverse movement of the motorboat, upper and lower lands 252 positioned between the corner lands 251, and a flat area 255 which is held against the corresponding front surface of the lower mount storage cavity 101 when the forward thrust forces are increased.

The rear surface 260 comprises four corner lands 261 which are held against the corresponding rear surface of the lower mount storage cavity 101 when the thrust forces are relatively small upon forward movement of the motorboat, upper and lower lands 262 positioned between the corner lands 261, and a flat area 265 which is held against the corresponding front surface of the lower mount storage cavity 101 when the forward thrust forces are increased.

The lower rubber mount 15 also has a pair of laterally spaced recesses 271 defined in its upper surface and extending transversely thereacross, i.e., in the fore-and-aft direction of the motorboat, a flat area 272 on the upper surface which extends between the recesses 271, and a pair of lands 273 on the upper surface which are positioned outwardly of the recesses 271. The lower rubber mount 15 also has a pair of laterally spaced recesses 275 defined in its lower surface and extending transversely thereacross in the fore-and-aft direction of the motorboat, a flat area 276 on the lower surface which extends between the recesses 275, and a pair of lands 277 on the upper surface which are positioned outwardly of the recesses 275. The lower rubber mount 15 further includes a pair of recesses 279 defined respectively in its opposite sides and extending transversely thereacross in the fore-and-aft direction of the motorboat.

The core 17 has a pair of laterally spaced bosses 281 and a joint 286 integrally joined to and extending between the bosses 281. The bosses 281 have respective forwardly opening bolt insertion holes 282 through which the bolts 19 are inserted, respective collar bearing surfaces 283 against which the collars 18 are held, and respective nut bearing surfaces 284 against which the nuts 19 are held.

Each of the bosses 281 has a surrounding central flange 285. The joint 286 is of a crisscross cross section and has a horizontal panel 287 and a vertical panel 249 on a central region of the horizontal panel 247.

As illustrated in FIGS. 5 and 6, the mount case 51 has a main oil return port 111 defined therein on one side of the coolant passage 96 remote from the upper mount storage cavity 99, an upwardly opening concave wall 112, and a downwardly opening concave wall 113.

The mount case 51 also has a pair of downwardly opening auxiliary oil return passages 114 disposed one on each side of the upper mount storage cavity 99. The auxiliary oil return passages 114 extend in the fore-and-aft direction of the motorboat with thermally insulating spaces 51*a* defined between the upper mount storage cavity 99 and the auxiliary oil return passages 114.

In FIG. 5, the mount case 51 has a mating surface 115 joined to the crankcase 31, and a mating surface 116 joined to the cylinder block 32. In FIG. 6, the mount case 51 has a mating surface 117 joined to the oil pan 64 and the upper mount cover 65, and a mating surface 118 joined to the extension case 61.

Operation of the vibroisolating means 11, 15 will be described below. When the outboard engine assembly 20 produces forward or reverse thrust forces, it is swung about an axis that is positioned between the upper and lower rubber mounts 12, 16. When the motorboat is propelled forwardly, the front surface 210 of the upper rubber mount 12 interferes with the front surface of the upper mount storage cavity 99, and the front surface 250 of the lower rubber mount 16 interferes with the front surface of the lower mount storage cavity 101.

More specifically, insofar as the forward thrust forces are relatively small, the corner lands 211, which are located outwardly of the arms 6*a*, i.e., the mating surface 243 (see FIGS. 10A through 10F), and the lands 212 of the front surface 210 of the upper rubber mount 12 are compressed against the front surface of the upper mount storage cavity 99. As the forward thrust forces are increased, the flat area 215 between the arms 6*a* are pressed against the front surface of the upper mount storage cavity 99, and serve as stoppers.

Likewise, insofar as the forward thrust forces are relatively small, the corner lands 251, which are located outwardly of the arms 8*a*, i.e., the mating surface 283 (see FIGS. 11A through 11F) are first compressed against the rear surface of the lower mount storage cavity 101, and then the lands 252 are compressed against the rear surface of the lower mount storage cavity 101. As the forward thrust forces are increased, the flat area 255 between the arms 8*a* are pressed against the rear surface of the lower mount storage cavity 101, and serve as stoppers.

When the motorboat is propelled rearwardly, the rear surface 220 of the upper rubber mount 12 interferes with the rear surface of the upper mount storage cavity 99, and the rear surface 260 of the lower rubber mount 16 interferes with the rear surface of the lower mount storage cavity 101.

More specifically, insofar as the reverse thrust forces are relatively small, the corner lands 221, which are located outwardly of the arms 6*a*, and the lands 222 of the rear surface 220 of the upper rubber mount 12 are compressed against the rear surface of the upper mount storage cavity 99. As the reverse thrust forces are increased, the flat area 225 between the arms 6*a* are pressed against the rear surface of the upper mount storage cavity 99, and serve as stoppers.

Likewise, insofar as the reverse thrust forces are relatively small, the corner lands 261, which are located outwardly of the arms 8*a*, i.e., the mating surface 284 (see FIGS. 11A through 11F) are first compressed against the rear surface of the lower mount storage cavity 101, and then the lands 262 are compressed against the rear surface of the lower mount storage cavity 101. As the reverse thrust forces are increased, the flat area 265 between the arms 8*a* are pressed against the rear surface of the lower mount storage cavity 101, and serve as stoppers.

As described above, the surface areas of the surfaces 210, 220, 250, 260 of the upper and lower rubber mounts 12, 16 as they contact the corresponding surfaces of the upper and lower mount storage cavities 99, 101 are increased when the thrust forces are increased. When relatively large forward or reverse thrust forces are applied and the flat areas 215, 225, 255, 265 are pressed against the corresponding surfaces, the upper and lower rubber mounts 12, 16 are relatively hard and can transmit the thrust forces reliably. When relatively small forward or reverse thrust forces are applied and the flat areas 215, 225, 255, 265 are not pressed against the corresponding surfaces, the upper and lower rubber mounts 12, 16 are relatively soft and can isolate or absorb vibrations as the lands 211, 212, 221, 222, 223, 251, 252, 261, 262 are compressed.

The arms 6*a* of the support member 6 and the core 13 of the upper rubber mount 12 of the vibroisolating means 11 jointly make up a closed loop, and the arms 8*a* of the support member 8, the core 17, and the collars 18 of the lower rubber mount 16 of the vibroisolating means 15 also jointly make up a closed loop. Therefore, the vibroisolating means 11, 15 provide sufficient rubber frame rigidity against vertical shocks that are produced when the motorboat jumps.

Inasmuch as the lower rubber mount 16 of the vibroisolating means 15 with the core 17 embedded therein extends transversely in the lower mount storage cavity 101, the moment of inertia of area of the lower rubber mount 16 can greatly be increased for sufficient rigidity even if the lower rubber mount 16 is of an increased size. The case assembly 60 composed of the extension case 61 and the gear case 71 is thus prevented from resonating with the engine 21.

Since the extension case 61 has the stiffeners 103 extending around the space which stores the collars 18 interconnecting the core 17 and the support member 8, nothing projects laterally from the collars 18, and the vibroisolating means 15 has sufficient rigidity and the moment of inertia of area thereof can greatly be increased.

The lower rubber mount 16 with the core 17 embedded therein can easily be assembled as it is inserted laterally into the lower mount storage cavity 101.

An oil circulation system of the engine 21 will be described below.

Oil in the oil pan 64 is drawn by the oil pump 55 through the strainer 66, the oil supply pipe 67, and the oil inlet passage 68 into the oil discharge passage 69. The oil then flows from the oil discharge passage 69 through an oil passage 121 defined in the crankcase 31, an oil passage 122 defined in the cylinder block 32, and an oil passage 123 defined in the cylinder head 33 to various parts to be lubricated.

After having lubricated the parts, the oil in the crankcase 31 and the oil in the cylinder head 33 flows downwardly onto the upper surface of the mount case 51, from which the oil flows into the main oil return port 111 and the auxiliary oil return ports 114. The auxiliary oil return ports 114 are effective as oil return paths when the outboard engine assembly 20 is tilted up.

Figure 12:
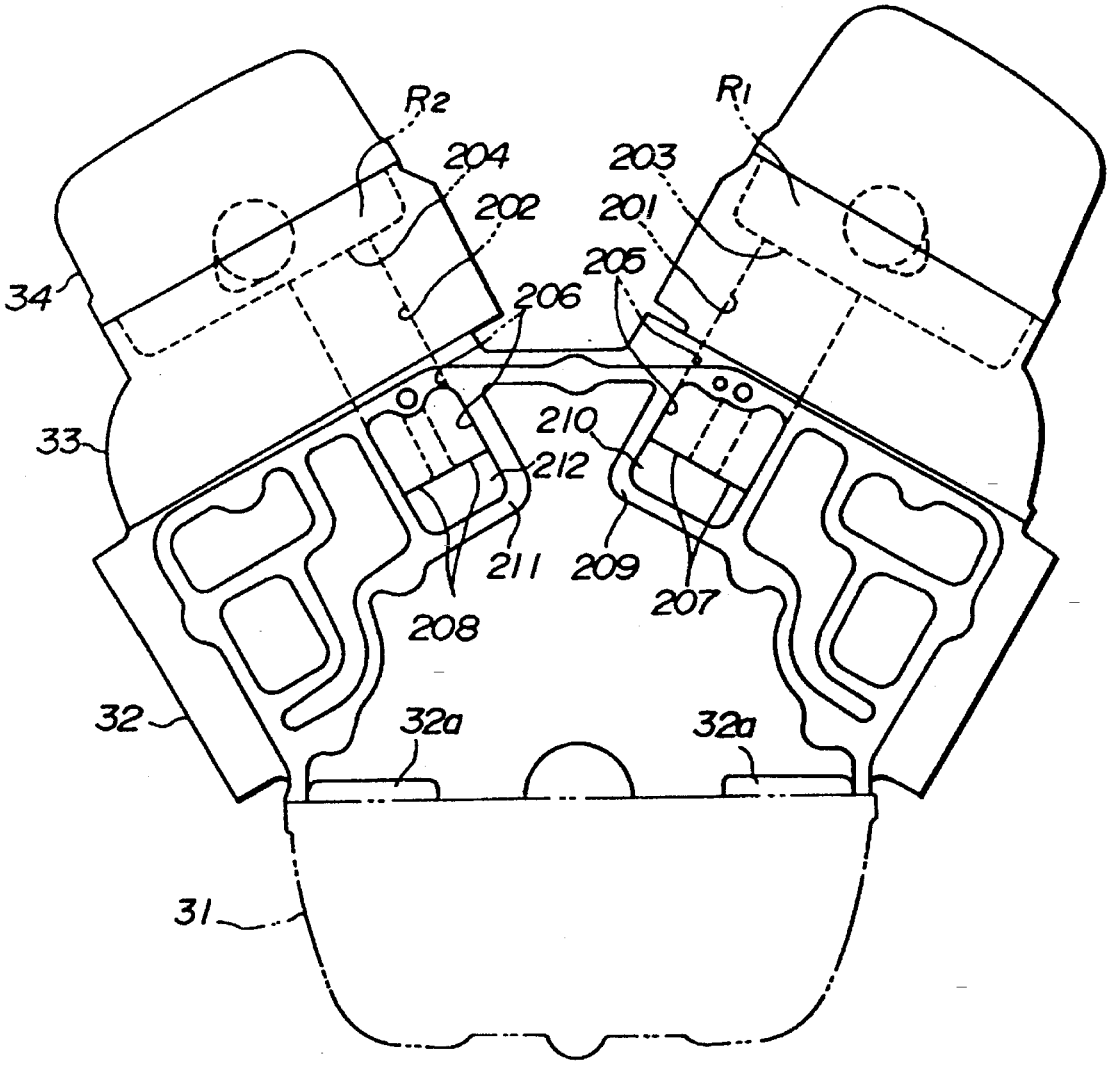
FIG. 12 is a bottom view of an engine of an outboard engine assembly according to another embodiment of the present invention.
Figure 13:
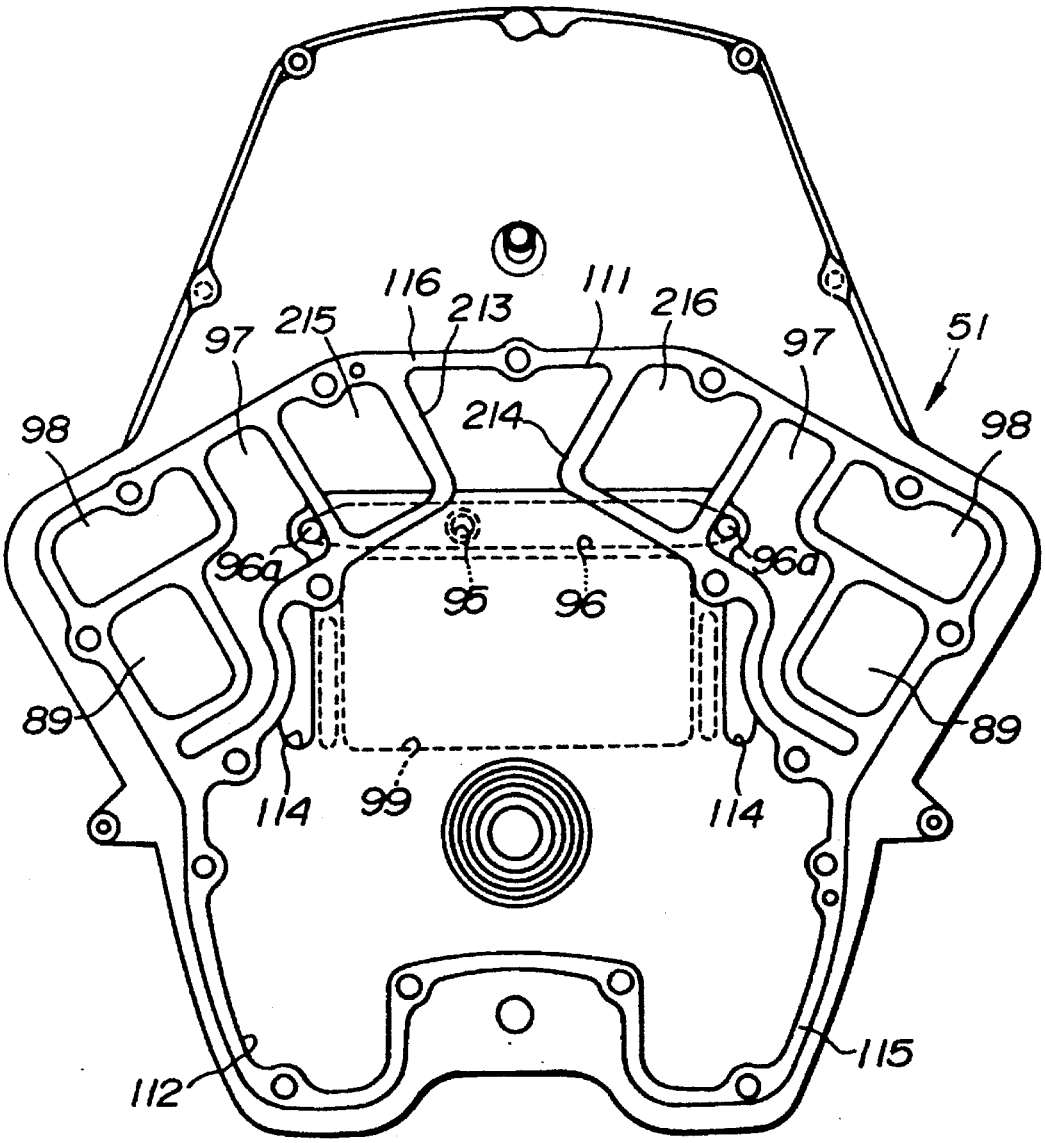
FIG. 13 is a plan view of a mount case of the outboard engine assembly shown in FIG. 12.
Figure 14:
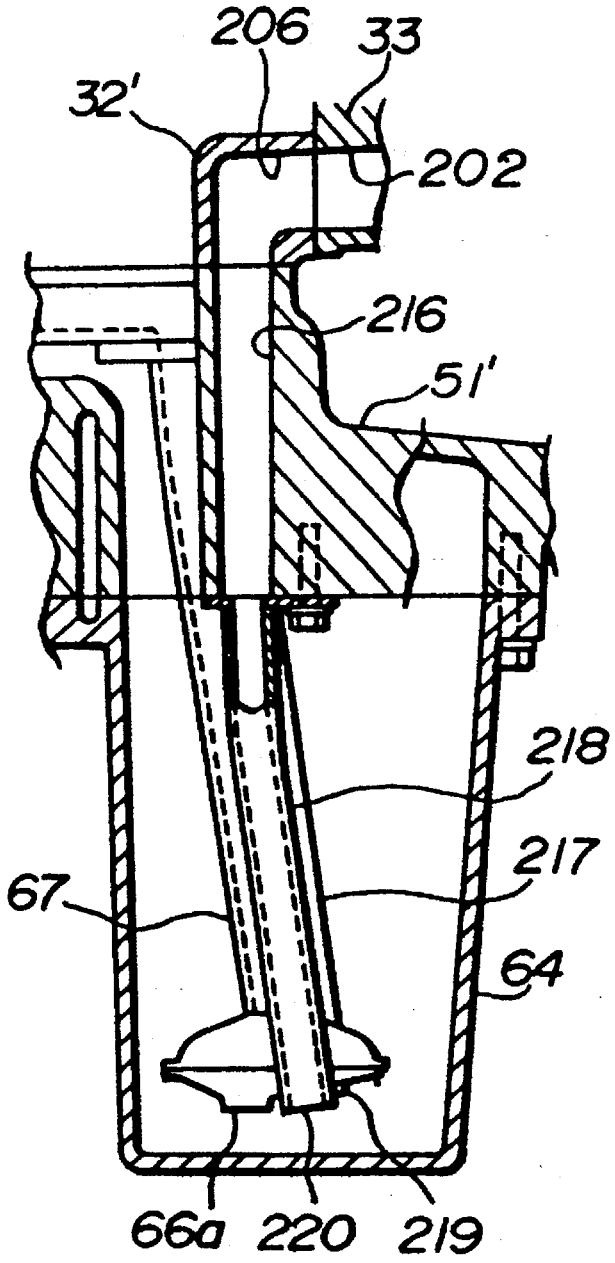
FIG. 14 is an enlarged cross-sectional view of an oil pan and associated components of the engine shown in FIG. 12.

FIGS. 12 through 14 show an outboard engine assembly according to another embodiment of the present invention.

In this embodiment, oil flows independently through oil return passages 215, 216 disposed one on each side of the main oil return port 111 back to the oil pan 64.

The other details of the outboard engine assembly shown in FIGS. 12 through 14 are basically the same as those of the outboard engine assembly according to the preceding embodiment, and will not be described in detail below.

In FIGS. 12 through 14, the engine mount case 51 has oil return passages 32*a* from the crank chamber of the cylinder block, a pair of laterally spaced cam chambers R1, R2, a pair of oil return passages 201, 202 defined respectively in laterally spaced portions of the cylinder head, a pair of oil return passages 203, 204 connected to the respective cam chambers R1, R2, and a pair of oil return passages 205, 206 defined in the respective banks of cylinders and having respective openings 207, 208 at cylinder block ends.

The engine also has gasket bearing surfaces and recesses 209, 211, 210, 212 on the lower cylinder block surface, and gasket bearing surfaces 213, 214 on the upper mount case surface. The oil return passages 215, 216 extend vertically through the mount case. Oil return pipes 217, 218 are mounted on the mount case, and have outlets 219, 220, respectively, opening in the oil pan 64.

The gasket bearing surfaces and recesses 209, 211, 210, 212 serve to guide oil from the cam chambers R1, R2 into the oil pan 64 without being mixed with oil from the crank chamber.

The oil return pipes 217, 218 return oil in the vicinity of an inlet of the oil strainer that communicates with the suction side of the oil pump. Therefore, the oil is smoothly returned to the oil pan 64 under the suction produced by the oil pump. Since the oil return pipes 217, 218 are independent of each other, oil can smoothly return to the oil pan 64 even when the outboard engine assembly is somewhat tilted laterally.

A coolant circulation system of the engine 21 will be described below.

As shown in FIG. 3, a coolant is supplied by the coolant pump 92 through the coolant chamber 91, the coolant outlet 93, and the hose 94 to the coolant inlet 95 of the upper mount cover 65, from which the coolant is fed to the coolant passage 96 and then from the holes 96*a* to the coolant passages 97.

The cylinder block 32 has a pair of coolant passages 131 (see FIG. 4) defined therein laterally of the respective exhaust passages 49 and opening into and communicating with the respective coolant passages 97. The coolant flows through the coolant passages 131 into coolant passages 132 defined around the cylinders 26 in the cylinder block 32, coolant passages 133 defined around the exhaust passages 48 in the cylinder head 33, and coolant passages 134 defined around the combustion chambers 47 in the cylinder head 33.

The coolant that has cooled the various engine components and has been heated to a certain temperature flows through a pair of discharge passages 135 defined along the coolant passages 131 in the cylinder block 31 and then from the coolant drain ports 98 into the extension case 61.

A thermostat 136 is disposed between one of the coolant passages 132 and the corresponding one of the discharge passages 135.

As shown in FIG. 6, the exhaust passage 87 defined in the lower portion of the mount case 51 between an upper portion of the exhaust chamber 83 and the exhaust port 88 is divided into a chamber 87*a* extending around the mating surface 117 and a chamber 87*d* communicating with the chamber 87*a* through holes 87*c* that are defined in a partition wall 87*b* rearwardly of the chamber 87*a*. A porous gasket ket P is interposed between the exhaust passage 87 and the extension case 61.

Figure 15:
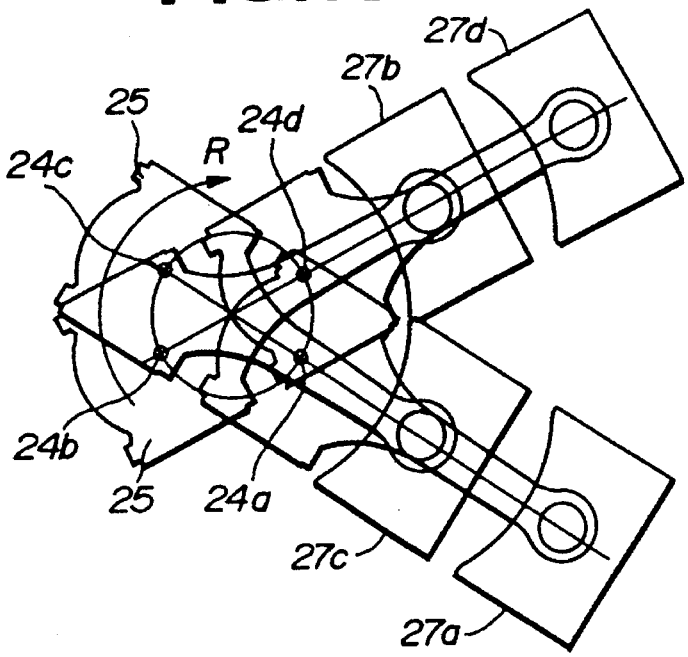
FIG. 15 is a schematic plan view illustrative of the angular relationship or phase between crankpins of the engine shown in FIG. 4.
Figure 16:
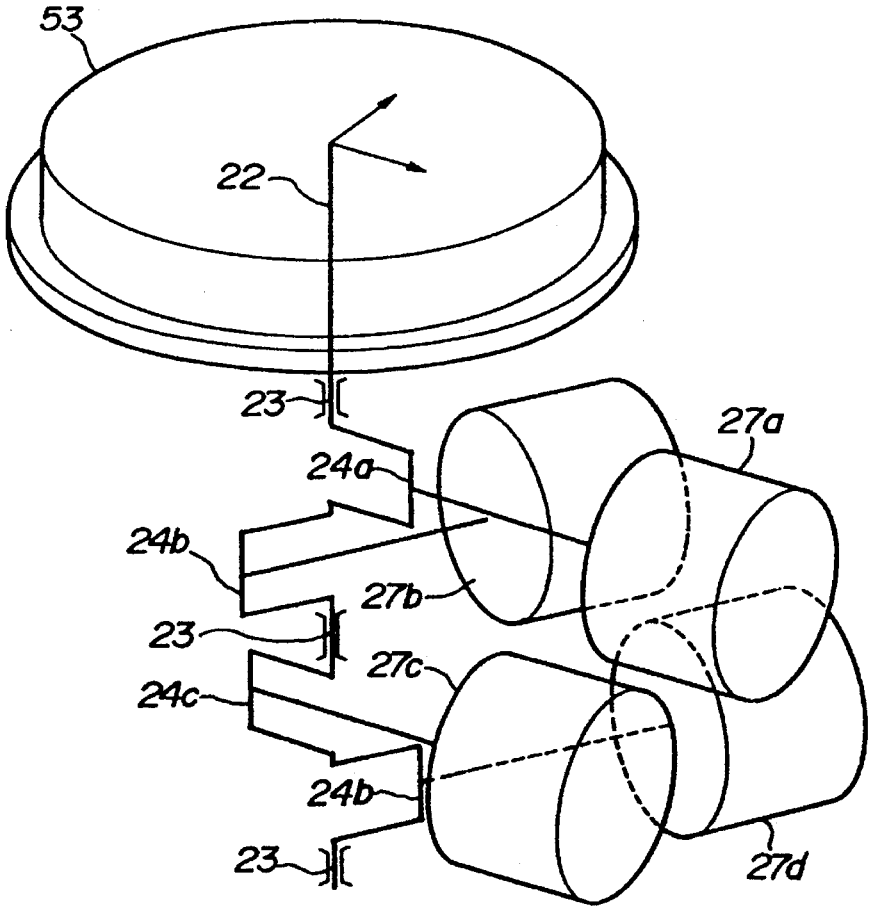
FIG. 16 is a schematic perspective view showing the angular relationship or phase between the crankpins shown in FIG. 15.

With the V-shaped four-cylinder four-stroke engine 21 whose cylinder axes C are angularly spaced 90° or less from each other, as shown in FIGS. 15 and 16, the crankpins 24 and the pistons 27 coupled thereto are denoted, successively in order from above, a first crankpin 24*a* and a first piston 27*a*, a second crankpin 24*b* and a second piston 27*b*, a third crankpin 24*c* and a third piston 27*c*, and a fourth crankpin 24*d* and a fourth piston 27*d*. The first piston 27*a* and the third piston 27*c* are slidably fitted in the corresponding cylinders of one bank, and the second piston 27*b* and the fourth piston 27*d* are slidably fitted in the corresponding cylinders of the other bank.

The first crankpin 24*a* and the third crankpin 24*c* are angularly spaced 180° from each other, i.e., angularly positioned 180° out of phase with each other, and the second crankpin 24*b* and the fourth crankpin 24*d* are angularly spaced 180° from each other, i.e., angularly positioned 180° out of phase with each other.

If the crankshaft 22 rotates in the direction indicated by the arrow R (FIG. 15), then the cylinders 26 which accommodate the first piston 27*a*, the second piston 27*b*, the fourth piston 27*d*, and the third piston 27*c* are ignited at equal intervals successively in the order named.

The inertial moment of the pistons 27 in the axial direction of the cylinders 26 is canceled out 0% by the crank webs 25.

The V-shaped four-cylinder four-stroke engine 21 is advantageous with respect to fuel economy and emission control. In addition, the V-shaped four-cylinder four-stroke engine 21 is made up of a smaller number of parts, is lighter, and has smaller height and width than the number of parts of conventional V-shaped six-cylinder four-stroke engines.

Because the first crankpin 24*a* and the third crankpin 24*c* are angularly positioned 180° out of phase with each other, and the second crankpin 24*b* and the fourth crankpin 24*d* are angularly positioned 180° out of phase with each other, any primary inertial forces are basically not produced, and any primary inertial couple is relatively small.

Furthermore, since the cylinders 26 which accommodate the first piston 27*a*, the second piston 27*b*, the fourth piston 27*d*, and the third piston 27*c* are ignited at equal intervals successively in the order named, any changes in reactive forces produced upon generation of the drive torque of the engine are minimized.

Consequently, with the V-shaped four-cylinder four-stroke engine 21 installed on the motorboat hull, vibrations transmitted from the engine to the motorboat hull can be suppressed without use of a primary inertial couple balancer.

Therefore, the engine 21 may be rendered compact particularly around the crankcase 31. The portion of the outboard engine assembly 20 which projects into the motorboat hull when it is tilted up is relatively small in size, resulting in an advantage in that two outboard engine assemblies can easily be mounted, side by side, on the stern of the motorboat.

Inasmuch as the V-shaped four-cylinder four-stroke engine 21 generates any primary inertial couple in a plane normal to the direction in which the thrust forces are produced, the effect of the primary inertial couple on the motorboat hull is virtually eliminated, resulting in a reduction in the level of vibrations transmitted to the motorboat hull.

If the crankshaft 22 rotates in a direction opposite to the direction R, then the first, third, fourth, and second cylinders may be ignited successively in the order named.

Figure 17:
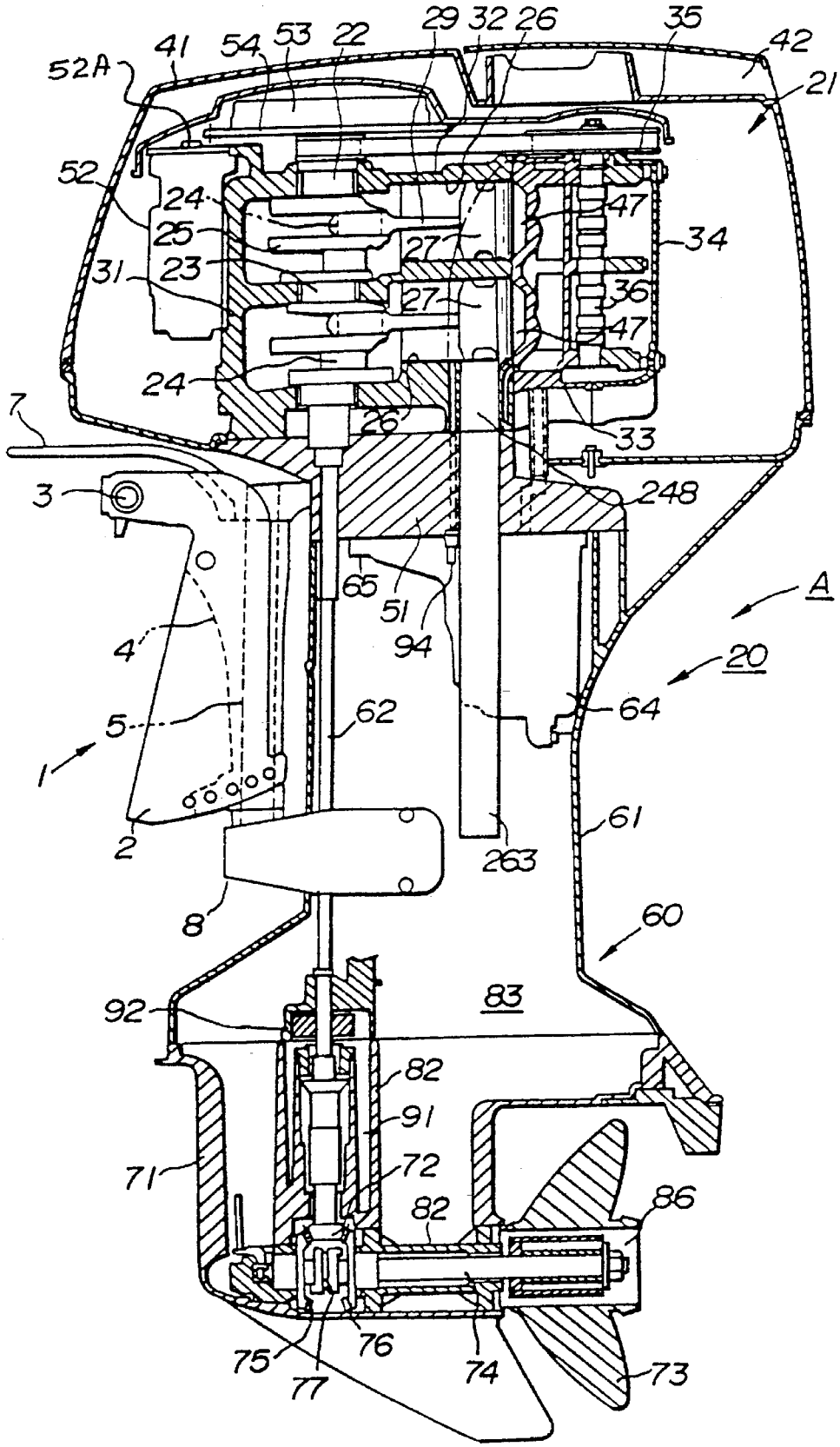
FIG. 17 is a vertical cross-sectional view of an outboard engine assembly according to still another embodiment of the present invention.
Figure 18:
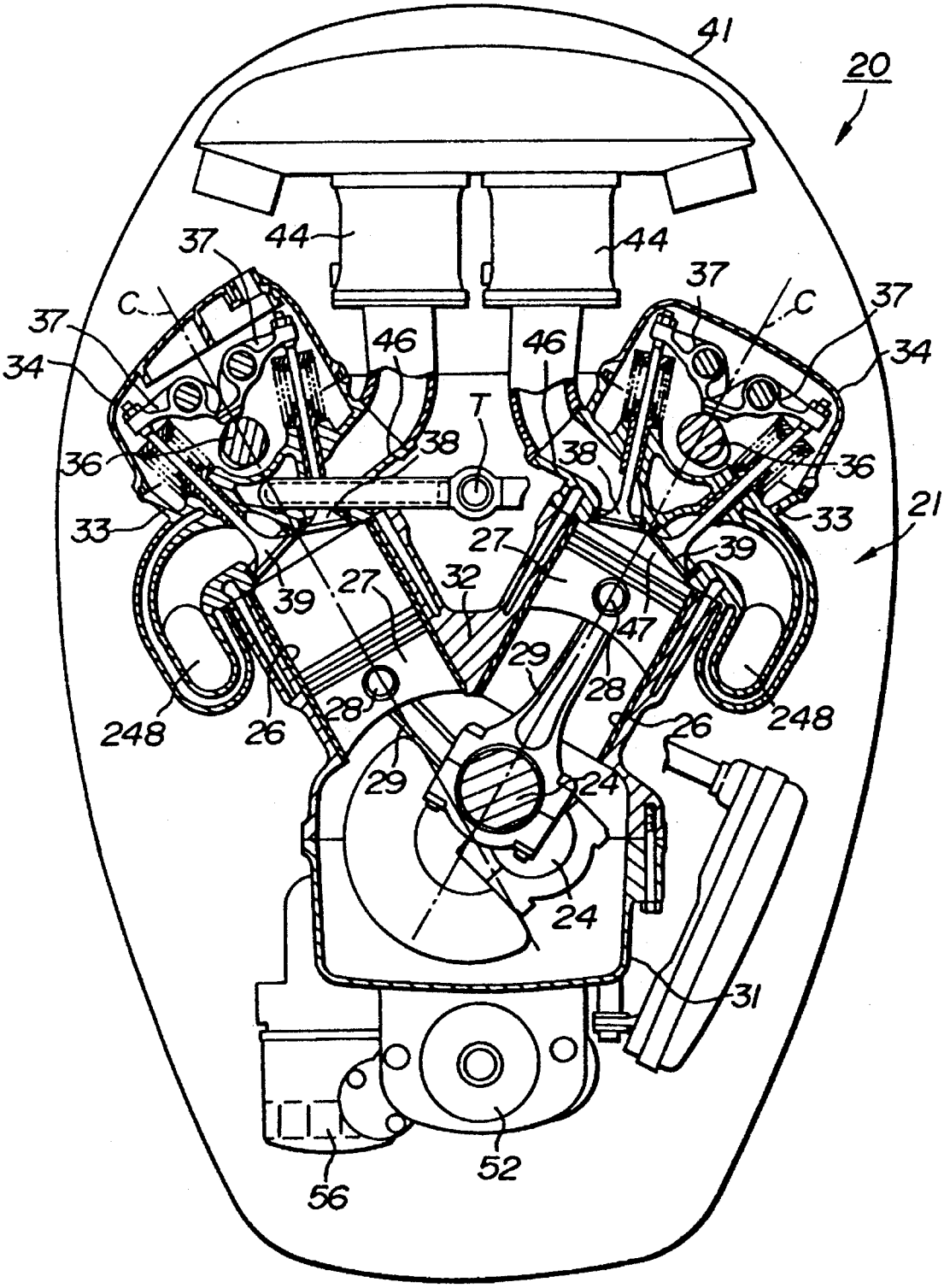
FIG. 18 is a horizontal cross-sectional view of an engine of the outboard engine assembly shown in FIG. 17.

FIGS. 17 and 18 show an outboard engine assembly according to still another embodiment of the present invention. Those parts shown in FIGS. 17 and 18 which are identical to those shown in FIGS. 3 and 4 are denoted by identical reference characters, and will not be described in detail below.

In FIGS. 17 and 18, the cylinder head 33 has a pair of exhaust passages 248 defined therein outwardly of the V-shaped banks of cylinders 26 and extending downwardly, and exhaust pipes 263 connected to the lower end of the respective exhaust passages 248.

The axes C of the cylinders 26 of the V-shaped banks are angularly spaced from each other by an angle of 90° or smaller.

The coolant discharged from the cylinders 26 of the V-shaped banks flows downwardly through a thermostat T (see FIG. 18).

Figure 19:
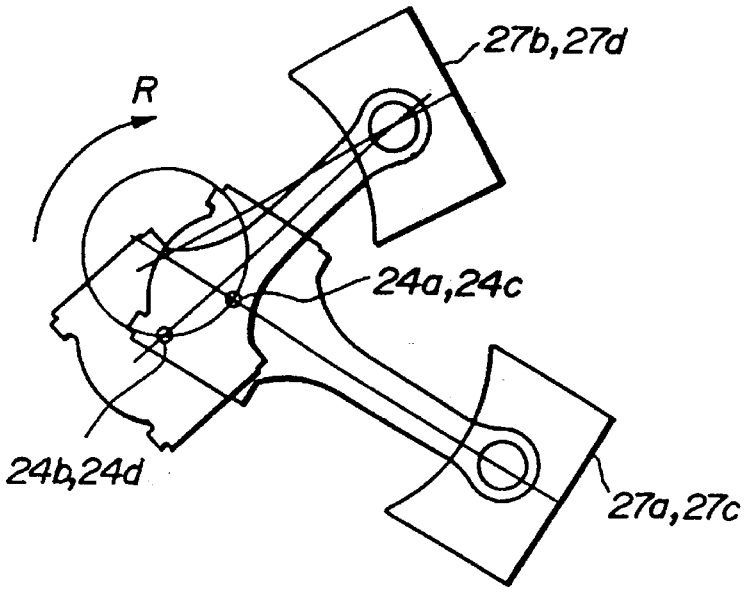
FIG. 19 is a schematic plan view illustrative of the angular relationship or phase between crankpins of the engine shown in FIG. 17.
Figure 20:
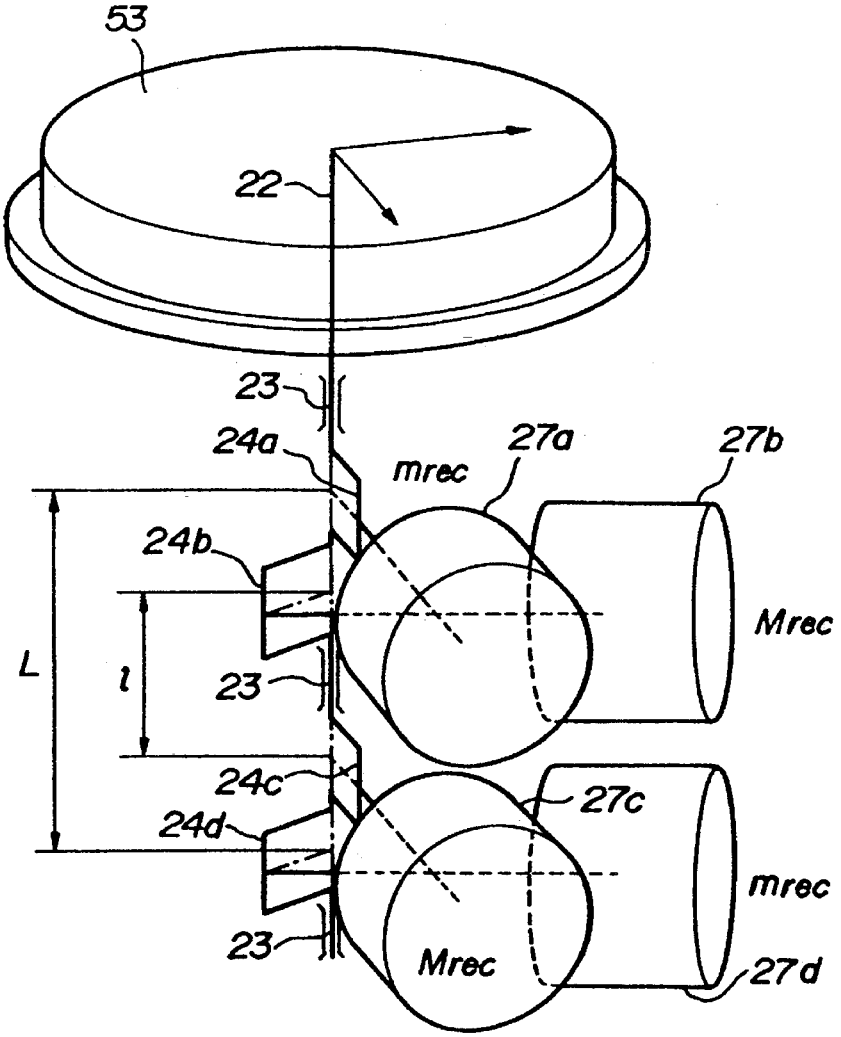
FIG. 20 is a schematic perspective view showing the angular relationship or phase between the crankpins shown in FIG. 19.

If it is assumed that the axes C of the cylinders 26 of the V-shaped banks are angularly spaced from each other by an angle of θ, then the first crankpin 24*a* and the second crankpin 24*b* are angularly spaced from each other by an angle of (π−2θ). As shown in FIGS. 19 and 20, the first crankpin 24*a* and the third crankpin 24*c* are angularly spaced 360° from each other, i.e., angularly positioned 360° out of phase, i.e., in phase, with each other, and the second crankpin 24*b* and the fourth crankpin 24*d* are angularly spaced 360° from each other, i.e., angularly positioned 360° out of phase, i.e., in phase, with each other.

If the crankshaft 22 rotates in the direction indicated by the arrow R (FIG. 19), then the cylinders 26 which accommodate the first piston 27*a*, the second piston 27*b*, the third piston 27*c*, and the fourth piston 27*d* are ignited at unequal intervals successively in the order named.

The inertial moment of the pistons 27 in the axial direction of the cylinders 26 is canceled out 50% by the crank webs 25.

Figure 21:
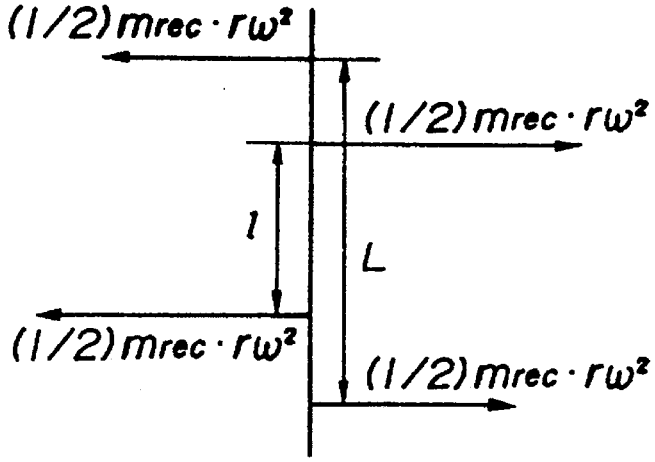
FIG. 21 is a schematic diagram illustrative of a balanced state of moments of reciprocating masses in cylinders of the engine shown in FIG. 17.

In the V-shaped four-cylinder four-stroke engine shown in FIGS. 17 and 18, the reciprocating mass including the piston 27*a* in the cylinder 26*a* corresponding to the first crankpin 24*a* is indicated by $m_{rec}$, the reciprocating mass including the piston 27*b* in the cylinder 26*b* corresponding to the second crankpin 24*b* is indicated by $M_{rec}$, the reciprocating mass including the piston 27*c* in the cylinder 26*c* corresponding to the third crankpin 24*c* is indicated by $M_{rec}$, and the reciprocating mass including the piston 27*d* in the cylinder 26*d* corresponding to the fourth crankpin 24*c* is indicated by $m_{rec}$. If the radius of crankshaft 22 is represented by r, the angular velocity of the crankshaft 22 is represented by ω, the distance between the first and fourth crankpins 24*a*, 24*d* is represented by L, and the distance between the second and third crankpins 24*b*, 24*c* is represented by 1, then the primary inertial couples are generated as shown in FIG. 21. More specifically, on the assumption that the inertial moment of the pistons 27 in the axial direction of the cylinders 26 is canceled out 50% by the crank webs 25, the primary inertial force generated by the first cylinder 26*a* is indicated by $(1/2)m_{rec}\cdot r\omega^2$, the primary inertial force generated by the second cylinder 26*b* is indicated by $(1/2)M_{rec}\cdot r\omega^2$, the primary inertial force generated by the third cylinder 26*c* is indicated by $(1/2)M_{rec}\cdot r\omega^2$, and the primary inertial force generated by the fourth cylinder 26*d* is indicated by $(1/2)m_{rec}\cdot r\omega^2$.

When $(1/2)m_{rec}\cdot r\omega^2\times L$ is equal to $(1/2)M_{rec}\cdot r\omega^2\times 1$ to balance the moments of the reciprocating masses in the cylinders, the primary inertial forces generated by the engine are completely canceled out.

Stated otherwise, when the reciprocating mass $M_{rec}$ in each of the second and third cylinders 26*b*, 26*c* is larger than the reciprocating mass $m_{rec}$ in each of the first and fourth cylinders 26*a*, 26*d*, the primary inertial forces generated by the engine are canceled out. Alternatively, the primary inertial forces generated by the engine are reduced depending on at least the difference $M_{rec}-m_{rec}$.

Specific arrangements for making the reciprocating mass $M_{rec}$ in each of the second and third cylinders 26*b*, 26*c* larger than the reciprocating mass $m_{rec}$ in each of the first and fourth cylinders 26*a*, 26*d* are described below.

Figure 22A:
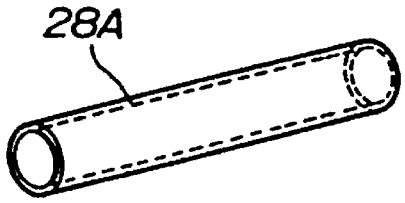
FIGS. 22A through 22C are perspective view of different piston pins.
Figure 22B:
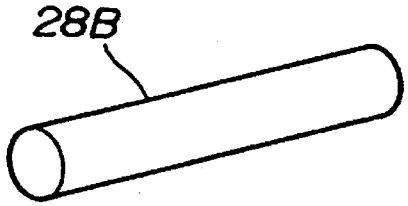
Figure 22C:
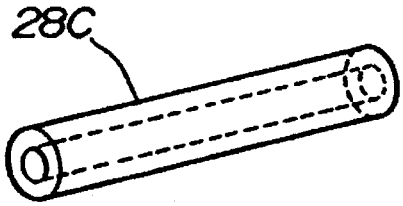

In these specific arrangements, the piston pins 28 have different weights to simplify mass adjustments and facilitate machining thereof. Specifically, each of the piston pins 28 of the first and fourth pistons comprises a hollow piston pin 28A as shown in FIG. 22A, and each of the piston pins 28 of the second and third pistons comprises a solid piston pin 28B as shown in FIG. 22B or a hollow piston pin 28C as shown in FIG. 22C which has a wall thickness greater than the hollow pin 28A as shown in FIG. 22A.

The V-shaped four-cylinder four-stroke engine 21 with the cylinder axes C angularly spaced by less than 90° is advantageous with respect to fuel economy and emission control. The V-shaped four-cylinder four-stroke engine 21 is made up of a smaller number of parts, is lighter, and has smaller height and width than the number of parts of conventional V-shaped six-cylinder four-stroke engines.

As described above, furthermore, the first and second crankpins 24*a*, 24*b* are angularly spaced from each other by π−2θ, the first crankpin 24*a* and the third crankpin 24*c* are angularly positioned 360° out of phase, i.e., in phase, with each other, and the second crankpin 24*b* and the fourth crankpin 24*d* are angularly positioned 360° out of phase, i.e., in phase, with each other, the inertial moment of the pistons 27 in the axial direction of the cylinders 26 is canceled out 50% by the crank webs 25, and the reciprocating mass $M_{rec}$ in each of the second and third cylinders 26*b*, 26*c* is larger than the reciprocating mass $m_{rec}$ in each of the first and fourth cylinders 26*a*, 26*d*. Therefore, even when the cylinders 26 which accommodate the first piston 27*a*, the second piston 27*b*, the third piston 27*c*, and the fourth piston 27*d* are ignited at unequal intervals successively in the order named, no primary inertial forces are basically generated by the engine. The primary inertial couple is smaller than it is if the cylinders are ignited at equal intervals, and any changes in reactive forces produced upon generation of the drive torque of the engine are smaller than if the crankpins are angularly positioned 180° out of phase with each other.

Consequently, as with the first embodiment described above, with the V-shaped four-cylinder four-stroke engine 21 installed on the motorboat hull, vibrations transmitted from the engine to the motorboat hull can be suppressed without use of a primary inertial couple balancer. Therefore, the engine 21 may be rendered compact particularly around the crankcase 31.

If the crankshaft 22 rotates in a direction opposite to the direction R in FIG. 19, then the first, fourth, third, and second cylinders may be ignited successively in the order named.

Although there have been described what are at present considered to be the preferred embodiments of the invention, it will be understood that the invention may be embodied in other specific forms without departing from the essential characteristics thereof. The present embodiments are therefore to be considered in all respects as illustrative, and not restrictive. The scope of the invention is indicated by the appended claims rather than by the foregoing description.

What is claimed is:

1. An outboard engine assembly having front, rear and side portions comprising:

cover means;

an engine disposed within said cover means, said engine including a crankshaft and a crankcase housing said crankshaft a cylinder block defining therein cylinders opened at an end thereof and a cylinder head closing the open end of said cylinders;

a mount case disposed underneath said engine and connected to the lower surfaces of said crankcase and said cylinder block;

an oil reservoir connected to the lower surface of said mount case;

an oil pump for drawing oil from said oil reservoir;

an oil filter disposed on the front side of said crankcase; and continuous oil passage means extending from said oil reservoir to said oil filter and defined in said crankcase and in said cylinder block and returning to said oil reservoir.

2. An outboard engine assembly according to claim 1, wherein said oil pump is coupled to said crankshaft at the lower end thereof; and said oil passage means in said crankcase provides lubrication of said engine parts therein.

3. An outboard engine assembly having front, rear, top, bottom and side portions comprising:

cover means;

an engine disposed within said cover means, said engine including a crankshaft and a crankcase housing said crankshaft;

a fly-wheel connected to one end of said crankshaft;

a starter motor disposed on said crankcase at a first elevation relative to said top portion, said starter motor being situated to be coupled with said fly-wheel upon starting operation of said engine; and an oil filter disposed on said crankcase on a second elevation different from said first elevation to such an extent that said starter motor and said oil filter do not interfere with each other in their positional relation.

4. An outboard engine assembly according to claim 3, wherein said starter motor and said oil filter are disposed on the front of said crankcase.

5. An outboard engine assembly according to claim 3, wherein said fly-wheel has on the outer periphery thereof a ring gear, said starter motor has an output pinion, whereby said ring gear and said pinion come into mesh with each other upon starting operation of said engine.

6. An outboard engine assembly having front, rear, top, bottom and side portions comprising:

cover means;

an engine disposed within said cover means, said engine including a crankshaft and a crankcase housing said crankshaft;

a starter motor disposed on said crankcase at a first elevation relative to said top portion on a first side of said engine; and an oil filter disposed on said crankcase in a second elevation different from said first elevation on said first side of said engine.

7. An outboard engine assembly according to claim 6 further comprising:

intake means disposed on the side other than said first side of said engine.

8. A four-stroke internal combustion engine having a front, rear, top and bottom, a vertically extending crankshaft in the top to bottom direction, and a central longitudinal axis extending in the front to rear direction; and v-shaped cylinders having axes thereof angularly spaced from each other in plan view comprising; a crankcase housing said crankshaft; an oil filter disposed on said crankcase, and a starter motor connected to said crankcase at said front of said engine substantially on said longitudinal axis of said engine, said oil filter being positioned on the front of said engine off-set from said longitudinal axis of said engine.

9. An outboard engine assembly comprising;

a cover means;

an engine disposed in the cover means, said engine including a crankshaft and a crankcase housing therein said crankshaft;

a starter motor disposed on said crankcase in a first level position on a first side of said engine; and an oil filter disposed on said crankcase in a second level position different from said first level position on said first side of said engine.

* * * * *